US007448825B2

(12) United States Patent
Kasahara et al.

(10) Patent No.: US 7,448,825 B2
(45) Date of Patent: Nov. 11, 2008

(54) METHOD FOR CONTINUOUS ON-SITE RECYCLING OF AN ASPHALT MIXTURE LAYER OF A PAVEMENT AND A MOTOR-DRIVEN VEHICLE SYSTEM THEREFOR

(75) Inventors: Atsushi Kasahara, Sapporo (JP); Shunsuke Ushio, Inba-gun (JP); Kojiro Ogata, Ishioka (JP); Hiroshi Inamitsu, Ushiku (JP); Fumio Goto, Yokohama (JP); Tomoyuki Abe, Minoo (JP); Hiroaki Irie, Amagasaki (JP); Isami Fujii, Kyoto (JP); Kazuo Onoda, Takasaki (JP); Hideo Ikeda, Hidaka (JP); Eisuke Nagai, Takasaki (JP); Atsuki Gomi, Ageo (JP); Masaki Tsunabuchi, Tsuchiura (JP)

(73) Assignees: Green Arm Co., Ltd., Tokyo (JP); Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 11/698,531

(22) Filed: Jan. 26, 2007

(65) Prior Publication Data

US 2007/0122235 A1 May 31, 2007

Related U.S. Application Data

(63) Continuation of application No. PCT/JP2004/018450, filed on Dec. 3, 2004.

(51) Int. Cl.
*E01C 23/12* (2006.01)
*E01C 7/32* (2006.01)

(52) U.S. Cl. ..... 404/80; 404/75; 404/77; 404/79; 404/81; 404/82; 404/83; 404/91; 404/95

(58) Field of Classification Search ..... 404/75, 404/77, 79–83, 91, 95, 101
See application file for complete search history.

(56) References Cited

U.S. PATENT DOCUMENTS 2,783,698 A * 3/1957 Bambi ..... 172/32

(Continued)

FOREIGN PATENT DOCUMENTS

JP 60-208502 A 10/1985

(Continued)

*Primary Examiner*—Raymond W Addie
(74) *Attorney, Agent, or Firm*—Cohen Pontani Lieberman & Pavane LLP

(57) ABSTRACT

A method for recycling in place an asphalt mixture layer of a paved road continuously, while moving a self-propelled vehicle system, which comprises a step of heating and softening the asphalt mixture layer, a step of scraping and breaking said hot and softened asphalt mixture layer and keeping the softened mixture at a temperature sufficient not to form an aggregate, to prepare an asphalt mixture having a single-grained structure, a sieving step of classifying said asphalt mixture having a single-grained structure into a plurality of grain size groups, a step of designing mix proportions for converting said asphalt mixture to a recycled asphalt mixture by the use of said plurality of grain size groups classified, a step of mixing uniformly said recycled asphalt mixtures having designed mix proportions, and a step of spreading and compacting said recycled asphalt mixtures having been mixed uniformly, to thereby form a recycled asphalt mixtures layer.

30 Claims, 8 Drawing Sheets

U.S. PATENT DOCUMENTS

| | | | | | |
|---|---|---|---|---|---|
| 4,398,842 | A | * | 8/1983 | Hodson | 404/82 |
| 4,534,674 | A | * | 8/1985 | Cutler | 404/75 |
| 4,601,605 | A | * | 7/1986 | Damp et al. | 404/95 |
| 4,619,550 | A | * | 10/1986 | Jeppson | 404/80 |
| 5,735,634 | A | * | 4/1998 | Ulrich et al. | 404/102 |
| 6,071,040 | A | * | 6/2000 | Macku et al. | 404/108 |
| 7,300,225 | B2 | * | 11/2007 | Musil | 404/79 |

FOREIGN PATENT DOCUMENTS

| | | | |
|---|---|---|---|
| JP | 03-199504 | A | 8/1991 |
| JP | 06-146212 | | 5/1994 |
| JP | 07-003715 | A | 1/1995 |
| JP | 11-117221 | | 4/1999 |
| JP | 2000-064220 | A | 2/2000 |
| JP | 2001-262509 | A | 9/2001 |
| JP | 2002-061140 | | 2/2002 |
| JP | 2002-079136 | | 3/2002 |
| JP | 2004-011406 | A | 1/2004 |
| JP | 2004-124549 | A | 4/2004 |
| WO | WO 92/17185 | | 9/1993 |
| WO | WO 93/17185 | | 9/1993 |
| WO | WO 96/07794 | | 3/1996 |

* cited by examiner

METHOD FOR CONTINUOUS ON-SITE RECYCLING OF AN ASPHALT MIXTURE LAYER OF A PAVEMENT AND A MOTOR-DRIVEN VEHICLE SYSTEM THEREFOR

RELATED APPLICATION

This application is a U.S. Continuation Application of International Application PCT/JP2004/018450 filed Dec. 3, 2004.

FIELD OF THE INVENTION

The present invention relates generally to a method for continuous on-site recycling of an asphalt mixture layer of a pavement and a motor-driven vehicle system used with the method, and, more particularly, to a method for continuous on-site recycling of a three-layer pavement construction comprising a roadbed, a sub-base laid on the roadbed and an asphalt mixture layer, the method being carried out with a motor-driven vehicle system moved along a road surface, by applying heat to the asphalt mixture layer to have the layer softened, and scarifying and loosening materials of thus softened asphalt mixture layer to divide the materials into particles under a temperature wherein re-aggregation of the loosened particulate materials can be prevented, to thereby provide particles of the divided materials of the asphalt mixture, and then reusing the scarified and loosened asphalt mixture as regenerated asphalt mixture to provide continuously a renewed asphalt mixture layer on the road.

BACKGROUND OF THE ART

A road pavement usually is of a three-layer pavement construction comprising a roadbed, a sub-base and an asphalt mixture layer as shown in FIG. 1, wherein the sub-base is provided on a compacted roadbed and comprises aggregates such as sand and crushed rocks added with a stabilizing agent such as a cement or petroleum asphalt emulsion, the sub-base being compacted after the stabilizing agent is added to the aggregates and being comprised of a lower layer and an upper layer for providing a required strength. The asphalt mixture layer comprises a base layer and a surface layer and is provided and compacted over the sub-base. In general, the term pavement is used to designate "a sub-base and an asphalt mixture layer", and the asphalt mixture includes particles of aggregate such as sand or crushed rocks, an asphalt which serves as a binder and stone powders (filler) comprised of limestone powders adapted to fill spaces in the particles of the aggregate .

As shown in FIG. 1, an asphalt mixture layer is formed in a two-layer construction comprising a base layer and a surface layer to be a water impermeable pavement typically comprised of a dense graded asphalt mixture layer having a void ratio of approximately 4%, the void ratio being defined as the volumetric ratio of voids in the mixture layer. In addition to such water impermeable pavement, a drainable pavement and a water permeable pavement having a void ratio of approximately 20% have been known. It should be noted however that a water permeable pavement allows water to pass to the roadbed possibly resulting in an adverse effect even the roadbed is caused to be weakened, so that such a water permeable pavement has not usually been adopted for the pavement of a heavy traffic road but has generally been adopted for pavements in side-walks or relatively light traffic roads.

Meanwhile, it has been known that paved roads which are subjected to heavy traffic due to busy vehicle transportation have problems of road surface deformation due to a road surface wear caused by being subjected to serious weather conditions for a prolonged time or due to a so-called "rutting" phenomenon, as well as road cracking due to deterioration, with the result that traffic safety is disturbed because rain water or thaw water may be trapped on the road surface causing a water splash or hydroplaning phenomenon, so that such road needs to be renewing of pavement through a repair work such as an asphalt repaving or patching.

A drainable pavement, generally referred as "an open graded asphalt mixture layer", has been developed in view of such problems, and comprises, as shown in FIG. 2, an asphalt layer construction including water impermeable base layer of an asphalt mixture disposed on the roadbed and a water permeable surface layer provided on the base layer, whereby rain water is guided and drained to drainage gutters or the like, not shown. To improve drainage capability, it has been proposed to increase the void ratio. However, the void ratio should not be increased at random because too large void ratio may cause problems such as strength reduction of a road surface layer itself, or viscosity degradation of the asphalt binder by softening asphalt binder based on increasing the temperature of a road surface layer with ambient temperature rise, and abruption of aggregates by driven vehicles based on such viscosity degradation.

Although the thickness of a pavement is determined by the strength of the roadbed (CRB value) and the traffic volume (N value) from the durability point of view, each thickness of a sub-base and an asphalt mixture layer is usually designed to be from two to three times in length of the maximum diameter of aggregates mixed therein. The maximum diameter of aggregates mixed into a sub-base is generally around 40 mm, thus the thickness of the sub-base is designed to be adapted to be around 100 to 120mm. Furthermore, the maximum diameter of aggregates mixed into an asphalt mixture layer is usually around 20 mm, thus each thickness of the base layer and the surface layer comprising the asphalt mixture layer is designed to be adapted to be around 40 to 50 mm, consequently the total thickness of the asphalt mixture layer may be around 80 to 100 mm.

The size of aggregate is referred as a particle size, and the mixture condition of these particles of aggregate which can be classified using screening device having a variety of screen meshes is referred as a particle size distribution. The particle size distributions of aggregates mixed into a dense graded, water impermeable asphalt mixture layer and into an open graded, water permeable asphalt mixture layer are obviously different. FIG. 3 and FIG. 4 show the respective particle size distributions. Each graph shows that the horizontal axis indicates the screen meshes, and the vertical axis indicates the weight percent of the particles of aggregate which have passed through each screen mesh (percentage passing by weight). Because aggregates may be typically grouped on the basis of 5 mm in diameter, particles of aggregate greater than 5 mm in diameter are called as coarse aggregates, and particles of aggregate smaller than 5 mm in diameter are called as fine aggregates. The coarse aggregates may also be grouped in more detailed manner, such as medium aggregates comprised of particles of aggregate greater than 5 mm and less than 13 mm in diameter, and coarse aggregates comprised of particles of aggregate greater than 13 mm and less than 20 mm in diameter. Since aggregates included in an asphalt mixture layer may be screened to be classified into two or three groups in many cases to be reused for recycling, the classification method as described above is also adopted here as a matter of convenience.

Referring to FIG. 3, it can be seen that particles of aggregates having particle size greater than 0.075 mm and less than 20 mm in diameter distribute continuously. This shows that the particle size distribution is such that the aggregates can be packed with a highest density, and the particle size distribution may be recognized as a continuous particle size distribution or particle size continuity, which is generally referred as "a dense graded asphalt mixture layer" and is of a water impermeable characteristics. FIG. 4 shows a particle size distribution of aggregates in which a group of medium size aggregates have been removed from materials including for example three groups of aggregates, such as a first group of fine size aggregates, a second group of medium size aggregates and a third group of coarse size aggregates. If coarse aggregates greater than 5 mm in diameter have been removed from the particles of aggregate classified into two groups in accordance with different particle sizes not shown here, the particle size distribution shows a distribution concentrated in particles of aggregate less than 5 mm in diameter. In both cases, particle size distribution graphs indicate particle size distributions with gap or discontinuity in particle size distributions neither continuous particle size distribution nor particle size continuity. However, where medium aggregates have been removed from the particles of aggregate classified into three groups in accordance with different particle sizes, particles of aggregate comprising fine aggregates fill up densely spaces in the particles of aggregate comprising coarse aggregates, due to a weight percent of coarse aggregates smaller than that, i.e. around 30%, of fine aggregates. In case of two groups classified into fine aggregates and coarse aggregates, asphalt mixture includes only particles of aggregate comprising fine aggregates because particles of aggregate comprising coarse aggregates have been removed. In each case, where fresh asphalt or the like has been added to remainder of particles of aggregate which medium aggregates of the three groups or coarse aggregates of the two groups have been removed to provide a renewed asphalt mixture layer, the pavement may also be "a dense graded, water impermeable asphalt mixture layer" having a void ratio of around 4%. On the other hand, where fresh asphalt or the like has been added to particles of aggregate comprising medium aggregates removed from the three groups or to particles of aggregate comprising coarse aggregates removed from the two groups to provide a renewed asphalt mixture layer, the pavement may also be "an open graded, water permeable asphalt mixture layer" having many voids therein caused by not containing fine aggregates less than 5 mm in diameter. These two types of asphalt mixture layer are also referred to as a dense graded asphalt mixture layer and a porous asphalt mixture layer, respectively.

There are two kinds of asphalt (binder) used as an aggregates binder, one is crude asphalt called as strait asphalt which is unmodified, the other is modified asphalt which modifying agent such as rubber or resin has been added to improve viscosity, as seen in the relation between temperature and viscosity shown in FIG. 5, an asphalt mixture comprised of asphalt and aggregates will be divided into aggregates without damages and liquid asphalt when the viscosity of any kinds of asphalt diminishes around 180 degrees centigrade. That is, aggregates covered by asphalt may disaggregate to be particles. Meanwhile, the viscosity of asphalt increases under a temperature less than 100 degrees centigrade, whereby aggregates covered by asphalt will begin to re-aggregate, and then the asphalt mixture comprised of aggregates and asphalt will completely solidify at normal ambient temperatures. In this state, such asphalt mixture is also called as an asphalt concrete. According to the simulation shown in FIG. 6, the critical asphalt temperature for disaggregating aggregates covered by asphalt is around 120 degrees centigrade.

So far, although an asphalt mixture layer of typical three-layer construction pavement has been described, as stated above, an asphalt mixture layer comprising road pavement, for a prolonged time, has problems of road surface deformation such as so-called "rutting" phenomenon due to road surface wear caused by being subjected to busy vehicle transportation and due to fluidization of the asphalt mixture layer due to softening of asphalt (binder) in accordance with a rising of an ambient temperature caused by being subjected to serious weather conditions, as well as road cracking due to deterioration. An on-site recycling pavement construction method for an existing pavement typically implies a construction method for a surface layer of a two-layer asphalt construction comprised of a surface layer and a base layer. It should be noted however that the present invention has been conceived a concept as an on-site recycling pavement construction method of an asphalt mixture layer including a construction method for a surface layer of an asphalt mixture layer because road surface deterioration due to road surface wear and so-called "rutting" phenomenon may extend to a base layer. Hereinafter, the invention will be described in comparison with the prior arts related to on-site recycling pavement construction methods.

In surface pavement work for various roads or airport runways, various repair or repaving construction processes have been adopted and these processes have included simple repair process and surface and/or base layer renewing process which have been chosen depending on applications. Meanwhile, recycling methods for recycling pavement materials generated by construction have been widely adopted since the enactment in Japan of Recycle Law in 1991, for example, from the viewpoint of saving pavement materials consumed in maintaining and repairing pavement of a road having a significantly large length, and, for preventing pavement materials from being discarded as industrial wastes. Such processes are usually implemented by transporting/carrying pavement materials removed from a road surface under construction to a remote processing plant generally located away from a worksite using a construction vehicle, whereby the once-used pavement materials are regenerated in the plant and then transferred back to the worksite for a second use. This is commonly referred as a "plant regeneration pavement process". Typically, a pavement renewal process is carried out, with or without the plant regeneration process combined therewith depending on the condition of road, by applying heat to a surface portion of an asphalt mixture layer to perform an on-site renewal, or by scarifying asphalt mixture and mixing with pavement sub-base materials. The former is ordinarily referred as an on-site road surface recycling process, while the latter is referred as an on-site sub-base recycling process. The present invention relates to the one which have been conceived based on the former process.

(Nonpatent literature 1): "Pavement Recycling Handbook" (Japan Road Association Aggregates Corporation)

Asphalt is comprised of particulate ingredient called as asphalting, and oil ingredient called as methane, and the content of methane tends to be decreases as the pavement is aged with the result that the asphalt is made harder and less viscous due to an increase in relative amount of asphaltene to methane. Furthermore, aggregates mixed in the asphalt mixture layer may be subjected to abrasion and breakage. Therefore, where materials of asphalt mixture removed from a road pavement are reused as old or once-used materials, it is necessary to ensure that the predetermined specifications shown in Table 1 are achieved by adding a rejuvenating agent such as softener, and, fresh asphalt mixture (new materials) and/or fresh asphalt as modifying agent, which are added in an amount appropriately metered in relation to the old or once-used materials. From an efficiency point of view, it is difficult to incorporate such blending step into a continuous on-site recycling process of an asphalt mixture layer of a pavement, so that the blending step is generally carried out as an off-line process wherein fixed or mobile plants are utilized to produce regenerated materials of asphalt mixture having predetermined specifications which are then transported back to the worksite. Although the plant regeneration pavement process has been established as a process for ensuring predetermined specifications, it is evident that technical and social issues caused by a loss of efficiency of application and disruption of traffic due to of the transportation from and to the worksite by construction vehicles due to the facts that the old materials must be carried back and forth between a plant and a worksite with the method. To improve such issues, mobile plant construction methods and plant vehicles have been also proposed.

(Patent literature 1): Japanese Patent Laid-Open Publication NO. 2002-079136A (Patent literature 2): Japanese Patent Laid-Open Publication NO. 2004-011406A (Patent literature 3): Japanese Patent Laid-Open Publication NO. H 7-003715A

TABLE 1

| Tested Items | | Typical Values |
|---|---|---|
| Penetration value (25° C.) | 1/10 mm | 40 and up |
| Softening point | ° C. | 80.0 and up |
| Ductility (15) | cm | 50 and up |
| Firing point | ° C. | 260 and up |
| Thin film oven mass rate of change | % | 0.6 and under |
| Thin film oven residual penetration | % | 65 and up |
| Toughness (25° C.) | N · m (kgf · cm) | 20 (200) and up |
| Tenacity (25° C.) | N · m (kgf · cm) | 15 (150) and up |
| Viscosity (60° C.) | Pa · s (Poise) | 20,000 (200,000) and up |

(1) Density (at 15° C.) should be written on a test sheet.
(2) Optimal mixture temperature range and optimal compaction temperature range should be written on a test sheet.

The so-called on-site road surface recycling process as described above is typically performed on the road by a sequence of process steps of applying heat to the road surface of an asphalt mixture layer by a road heater for recycling to be softened, scarifying and loosening materials of thus softened asphalt mixture layer, adding a rejuvenating agent such as softener or the like to the materials to be mixed therewith, optionally adding fresh asphalt mixture (new materials) and/or fresh asphalt as modifying agent and mixing them again together to produce a regenerated asphalt mixture, finally spreading and compacting the regenerated asphalt mixture by means of a screed or the like. There are two construction methods used for the purpose, one being a process referred as a remixing method wherein a rejuvenating agent and fresh asphalt mixture (new materials) and/or fresh asphalt may be added to the old materials in order to improve viscosity of asphalt materials and the binding force of the asphalt materials in the old materials and mixed them together to produce a one-layer construction of a renewed asphalt mixture layer, the other being a process referred as a repaving method, which can be adopted where it is not necessary to renew an asphalt mixture layer to improve quality, or where only minor improvements are needed, for producing a renewed asphalt mixture layer of a two-layer construction comprised of an old material layer and a new material layer paved on the old material layer. There have been proposed a number of approaches for improving properties of the regenerated asphalt mixture used for an on-site road surface recycling method. An example may include a surface recycling process performed by steps of forming grooves in advance along the road in a transverse, width direction by cutting the road pavement at the opposite sides of the road and removing materials of asphalt mixture generated by cutting, and then scarifying and loosening an existing road surface layer between the grooves, and spreading and compacting the scarified and loosened materials of the road surface layer back over the entire road surface throughout the width, and finally adding the same amount of new materials as that removed for forming the grooves in the opposite sides in order to adjust a height of the road, another type of recycling method of forming a road surface layer from an existing open graded, water permeable asphalt mixture layer being the one performed by steps of removing a part of the surface layer from materials of an existing asphalt mixture layer, and instead adding new materials so that spaces in the aggregates may be remained. In this regard, however, anyone of known on-site recycling methods does not need to contemplate recycling materials of an existing asphalt mixture as raw materials on the road by reusing and blending all or a part of aggregates in different diameter including the existing asphalt mixture. In the known methods, therefore, there have been no idea of restoring regenerated aggregates to be used as raw materials on the road, and blending the regenerated aggregates to reuse them on the road. Furthermore, known construction methods are not able to assure particle size distributions as described in FIG. 3 and FIG. 4, because a sequence of construction steps on the road are not based on screening aggregates included in an existing asphalt mixture to classify into multiple particle size distributions by a screening device or the like, and measuring them by a measuring device, and then blending them by a blending device to produce regenerated materials of asphalt mixture. In other words, it is impossible to assure a variety of predetermined performances completely because their steps are not incorporated into the sequence of construction steps. AR2000, which is manufactured and distributed by the applicant; is a state-of-the-art construction method that allows continuous recycling of an asphalt mixture of pavement on the road while the motor-driven vehicle system moves under automatic control at an average speed of 4 to 5 m/minute. However, a variety of predetermined specifications can not be ensured with even this system which operates similarly to known construction methods.

(Nonpatent literature 2): "Pavement Recycling Handbook" (Japan Road Association Aggregates Corporation)

(Patent literature 4): Japanese Patent Laid-Open Publication NO. 2004-124549

(Patent literature 5): Japanese Patent Laid-Open Publication NO. 2001-262509

Although a variety of construction methods relating to recycling of asphalt mixture (old materials) on the road have been suggested other than those described above including component technology, anyone of these methods is also unable to ensure a variety of predetermined performances completely, because they are not based on incorporating steps of screening aggregates in different diameter mixed into materials of asphalt mixture (old materials) to classify into multiple particle size distributions, measure them, and blending the particles of aggregate included in the materials of asphalt mixture as regenerated materials, into a sequence of construction steps on the road.

(Patent literature 6): Japanese Patent NO. 3293626

(Patent literature 7): Japanese Patent NO. 3380590

(Patent literature 8): Japanese Patent Laid-Open Publication NO. H11-117221

(Patent literature 9): Japanese Patent Laid-Open Publication NO. 2002-061140

Because any known on-site recycling pavement construction methods of an existing pavement including a step of performing a recycling plant process of materials of asphalt mixture (old materials) therein, require additional steps of process for transporting the old materials and the regenerated materials of asphalt mixture to and from between a recycling plant and a worksite as described above, it is difficult to avoid increasing green house gasses due to incoming and outgoing vehicles and due to traffic jams caused by road closure for prolonged time, and also prolonging of construction term and increasing of construction cost in accordance with reduction of construction efficiency. Furthermore, it is possible to take place insufficient compaction, low density and decreased adhesive force with aggregates caused by decreasing a temperature of materials of asphalt mixture until their arrival to a worksite because a recycling plant is usually located away from the worksite when a renewed asphalt mixture layer has been produced.

Meanwhile, known on-site recycling pavement construction methods as described above enable one to add a rejuvenating agent and new materials to old materials, and mix them together to produce a regenerated asphalt mixture on the road, and then spread and compact the regenerated asphalt mixture. However, a system has not been developed so far to enable one to apply heat to the asphalt mixture layer to be softened, scarify and loosen materials of thus softened asphalt mixture layer to divide the materials into particles under a temperature wherein re-aggregation of the loosened particulate materials can be prevented to thereby provide particles of the divided materials of the asphalt mixture, screen the particles of the divided materials of the asphalt mixture to classify into a plurality of groups of different particle size distributions in accordance with particle sizes, blend continuously particles of different particle sizes in the plurality of groups to provide a regenerated asphalt mixture which meets predetermined specifications or performances on the road as carrying out in a recycling plant, mix uniformly the regenerated asphalt mixture, and then spread and compact the uniformly mixed, regenerated asphalt mixture over the road surface to provide a renewed asphalt mixture layer over the road surface. There are premises enabling these developments by resolving technical problems which have been proposed in a patent literature of Japanese Patent NO. 3466621 adopted in AR2000 as described above. The techniques shown in the patent literature enable materials in depth of 40 to 50 mm of an asphalt mixture layer to heat up around 80 degrees Centigrade in a short period of time while keeping the surface temperature of the existing asphalt mixture layer at around 230 degrees Centigrade, by using a heating method and device for spraying and circulating a blast of hot air at around 600 degrees Centigrade to a road surface of an asphalt mixture layer with a motor-driven vehicle system moved along the road surface, whereby the asphalt mixture layer from the surface to the depth of 40 to 50 mm of an existing pavement may be scarified and loosened materials of an asphalt mixture layer to divide the materials including asphalt-coated-aggregates into particles under a temperature wherein re-aggregation of the loosened particulate materials can be prevented, to thereby provide particles of the divided materials of the asphalt mixture without damages.

(Patent literature 10): Japanese Patent NO. 3466632

So far, it is impossible to alter the functions or aspect of the asphalt mixture layer by incorporating the modification of particle size distribution comprising aggregates into a sequence of known on-site construction steps, with the result that such particle size distribution comprising aggregates have not been able to be converted into raw materials for recycling by reprocessing materials of asphalt mixture at a worksite in the prior arts. In other words, it is obvious that an open graded, water permeable asphalt mixture layer cannot be formed continuously on the road by reusing raw materials regenerated from an existing dense graded, water impermeable asphalt mixture layer at a worksite in the prior arts. More particularly, there has been no idea related to incorporating a reprocess capable of blending particle size distribution comprising aggregates included in an existing asphalt mixture layer into a sequence of construction steps. Patent literature 3 describes, "A road pavement vehicle wherein includes at least means for screening and classifying crushed asphalt-concrete scrap and/or cement-concrete scrap, means for mixing, measuring and feeding the screened and classified asphalt-concrete scrap and/or cement-concrete scrap as regenerated aggregates in different diameters with specified ratios thereof, means for mixing, measuring and feeding fresh aggregates in different diameters with specified ratios, means for measuring and feeding fresh asphalt, and then means for mixing said regenerated aggregates, said fresh aggregates and said fresh asphalt with applying heat thereto by means for heating." Although this is a vehicle-type-plant that provides a hopper, a screener and a mixer equipped on a frame of a carriage which can be placed near a construction worksite, and can be blended old materials crushed mechanically to meet desired specifications or performances thereof, this is not a vehicle configured a portion of a system that is incorporated a step for regenerating old materials continuously on the road into a sequence of construction steps. In other words, this is a vehicle of a type of mobile plants. It is obvious that such vehicle is not based on the concept of producing raw materials from aggregates included in old materials of an existing asphalt mixture layer to blend and reuse them on the road. More particularly, this is not a vehicle which is able to apply heat to old materials of an existing asphalt mixture layer to be soften, scarify and loosen the old materials to divide the old materials into particles of aggregate under a temperature wherein re-aggregation of the scarified and loosened old materials can be prevented, to thereby provide particles of the divided old materials of the asphalt mixture, screen the particles of aggregate to classify into multiple particle size distributions to produce raw materials, incorporate a step of blending process for them into a sequence of construction steps on the road by measuring the weight thereof as a reprocessing in an asphalt recycling plant, and then form continuously a regenerated asphalt mixture layer of a pavement on the road.

SUMMARY OF THE INVENTION

The resolution of issues mentioned above can be achieved by the present invention which is based on findings that by maintaining once-used asphalt mixture thermally softened and scarified into particles comprising aggregates and asphalt at a temperature under which the particles do not aggregate again, then screening and classifying particles through a plurality of screens having different mesh sizes, the fine aggregates smaller for example than 5 mm may pass through a final stage screen, whereas the aggregates coarser than that size, for example, medium size and/or coarse size aggregates may be screened by screens of preceding stage, so that by using metered quantities of such materials of different sizes, blending of asphalt mixture can practically be conducted, and which includes the features described in the followings.

One aspect of the present invention is directed to a method for continuous on-site recycling of an asphalt mixture layer of a pavement with a motor-driven vehicle system moved along a road surface, the method comprising the steps of: a) applying heat to the asphalt mixture layer to be softened; b) scarifying and loosening materials of thus softened asphalt mixture layer to divide the materials into particles under a temperature wherein re-aggregation of the loosened particulate materials can be prevented, to thereby provide particles of the divided materials of the asphalt mixture; c) screening the particles of the divided materials of the asphalt mixture to classify into a plurality of groups of different particle size distributions in accordance with particle sizes; d) blending particles of different particle sizes in the plurality of groups to provide regenerated asphalt mixture having one or more particle size distributions appropriate for use in pavement; e) mixing uniformly the regenerated asphalt mixture; and f) spreading and compacting the regenerated and uniformly mixed asphalt mixture over the road surface on which said steps a)and b) have been carried out to provide a renewed asphalt mixture layer on the road surface.

The present invention can include the feature wherein said step of scarifying and loosening materials of the softened asphalt mixture layer to divide the materials into particles under a temperature wherein re-aggregation of loosened particulate materials can be prevented, to thereby provide particles of the divided materials of the asphalt mixture, and/or, said step of blending particles of different particle sizes in the plurality of groups to provide regenerated asphalt mixture having one or more particle size distributions appropriate for use in pavement further include a step of adding a rejuvenating agent such as softener.

The present invention can include the feature wherein said step of blending particles of different particle sizes in the plurality of groups to provide regenerated asphalt mixture having one or more particle size distributions appropriate for use in pavement further includes a step of storing one or more unused groups of particles of different particle sizes in said plurality of groups, and then discharging the unused groups of particles out of the motor-driven vehicle system.

The present invention can include the feature wherein said step of blending particles of different particle sizes in the plurality of groups to provide regenerated asphalt mixture having one or more particle size distributions appropriate for use in pavement further includes a step of adding fresh asphalt mixture (new materials) to the blended and regenerated asphalt mixture.

The present invention can include the feature wherein said step of adding fresh asphalt mixture (new materials) to the blended and regenerated asphalt mixture further includes a step of adding a further fresh asphalt as modifying agent to the regenerated asphalt mixture to which the fresh asphalt mixture (new materials) has been added.

The present can include the feature wherein said step of spreading and compacting the regenerated and uniformly mixed asphalt mixture over the road surface on which above-mentioned steps a) and b) have been carried out to provide a renewed asphalt mixture layer on the road surface further includes a step of spreading and compacting the uniformly mixed, regenerated asphalt mixture to provide a two-layer construction having a base layer and a surface layer, wherein at least the base layer of the two-layer construction is a water impermeable, renewed asphalt mixture layer.

Another aspect of the present invention is directed to a method for continuous on-site recycling of an asphalt mixture layer of a pavement to provide an open graded, water permeable asphalt mixture layer with a motor-driven vehicle system moved along a road surface, the method comprising the steps of: a) applying heat to the asphalt mixture layer to be softened; b) scarifying and loosening materials of thus softened asphalt mixture layer to divide the materials into particles under a temperature wherein re-aggregation of the loosened particulate materials can be prevented, to thereby provide particles of the divided materials of the asphalt mixture; c) screening the particles of the divided materials of the asphalt mixture to classify into a plurality of groups of different particle size distributions in accordance with particle sizes; d) blending particles of different particle sizes in the plurality of groups to provide regenerated asphalt mixture having one or more particle size distributions appropriate for use in pavement; e) mixing uniformly the regenerated asphalt mixture; f) said mixing uniformly including the steps of (i) mixing uniformly a part of the blended and regenerated asphalt mixture to provide a first regenerated asphalt mixture for forming a renewed and dense graded, water impermeable asphalt mixture layer; (ii) mixing uniformly all or a part of the remainder of the blended and regenerated asphalt mixture to provide a second regenerated asphalt mixture for forming a renewed and open graded, water permeable asphalt mixture layer; g) spreading and compacting the first regenerated asphalt mixture over the road surface on which said steps a)and b) have been carried out to provide a renewed and dense graded, water impermeable asphalt mixture layer; and h) spreading and compacting the second regenerated asphalt mixture over the road surface on which said step g) has been carried out to provide a renewed and open graded, water permeable asphalt mixture layer on the renewed, water impermeable asphalt mixture layer.

The present invention can include the feature wherein said step of scarifying and loosening materials of the softened asphalt mixture layer to divide the materials into particles under a temperature wherein re-aggregation of loosened particulate materials can be prevented, to thereby provide particles of the divided materials of the asphalt mixture, and/or, said step of blending particles of different particle sizes in the plurality of groups to provide regenerated asphalt mixture having one or more particle size distributions appropriate for use in pavement further include a step of adding a rejuvenating agent such as softener.

The present invention can include the feature wherein said step of screening the particles of the divided materials of the asphalt mixture to classify into a plurality of groups of different particle size distributions in accordance with particle sizes comprises a step of screening the particles of the divided materials of the asphalt mixture to classify into two groups comprising fine aggregates and coarse aggregates, or three groups comprising fine aggregates, medium aggregates and coarse aggregates in accordance with particle sizes.

The present invention can include the feature wherein said step of blending particles of different particle sizes in the plurality of groups to provide regenerated asphalt mixture having one or more particle size distributions appropriate for use in pavement further includes a step of storing one or more unused groups of particles of different particle sizes in the plurality of groups, and then discharging said unused groups of particles out of the motor-driven vehicle system.

The present invention can include the feature wherein said step of blending particles of different particle sizes in the plurality of groups to provide regenerated asphalt mixture having one or more particle size distributions appropriate for use in pavement further includes a step of adding fresh asphalt mixture (new materials) to the blended and regenerated asphalt mixture.

The present invention can include the feature wherein said step of adding fresh asphalt mixture (new materials) to the blended and regenerated asphalt mixture further includes a step of adding fresh asphalt as modifying agent to the regenerated asphalt mixture to which the fresh asphalt mixture (new materials) has been added.

Another aspect of the present invention is directed to a motor-driven vehicle system including at least a pre-heater vehicle, a miller vehicle, a blender vehicle and a mixer vehicle for continuous on-site recycling of an asphalt mixture layer of a pavement with the motor-driven vehicle system moved along a road surface, wherein: a) said pre-heater vehicle having a device adapted to be disposed against the road surface for applying heat to the asphalt mixture layer to be softened; b) said miller vehicle having a device for scarifying and loosening materials of thus softened asphalt mixture layer to divide the materials into particles under a temperature wherein re-aggregation of the loosened particulate materials can be prevented, to thereby provide particles of the divided materials of the asphalt mixture; c) said blender vehicle being provided with a device located at front thereof for scooping and transporting the scarified and loosened asphalt mixture, and, a blending device located adjacent to said scooping and transporting device, said blending device including a screening device for screening the scooped and transported particles of the divided materials of the asphalt mixture to classify into a plurality of groups of different particle size distributions in accordance with particle sizes, and a measuring device for measuring particles of different particle sizes of the plurality of groups classified by the screening device, said blending device being configured for dispensing all or a part of the plurality of classified and measured groups onto the road surface; d) said mixer vehicle being provided with a mixing device such as a pig mill adapted to be disposed against the road surface and having a front inlet and a back outlet for receiving, all or a part of the materials in the plurality of groups of different particle size distributions which have been dispensed onto the road surface and uniformly mixing the received materials and dispensing again, said mixer vehicle being further provided adjacent to said mixing device with a spreading and compacting device such as one or more sets of auger and screed for spreading and compacting all or a part of the uniformly mixed and dispensed groups of materials to provide a renewed asphalt mixture layer.

The present invention can include the feature wherein said pre-heater vehicle comprises one or more vehicles, each having at least a heating device adapted to be disposed against the asphalt mixture layer to be softened and apply heat thereto.

The present invention can include the feature wherein said scarifying and loosening device of said miller vehicle includes one or more grinders.

The present invention can include the feature of said miller vehicle being further provided in front of said scarifying and loosening device with a heating device adapted to be disposed against the asphalt mixture layer to be softened for applying heat continuously thereto.

The present invention can include the feature wherein a reservoir for a rejuvenating agent such as softener is provided rearwards of said scarifying and loosening device of the miller vehicle, and/or, rearwards of or in front of said mixing device of the mixer vehicle, said rejuvenating agent being added to the asphalt mixture which has been scarified and loosened by said scarifying and loosening device of the miller vehicle, and/or, to the asphalt mixture which has been classified and measured by said blending device of the blender vehicle.

The present invention can include the feature of said miller vehicle further including a receiving/transporting device comprising a receiving section such as a hopper provided at a front portion and transport section such as a conveyor provided at an upper portion, said receiving/transporting device being adapted to receive a fresh asphalt mixture (new materials) supplied exteriorly of the motor-driven vehicle system, under a temperature wherein re-aggregation of the loosened particulate materials can be prevented, and to transport the fresh asphalt mixture to the blender vehicle.

The present invention can include the feature wherein said screening device contained in said blending device of said blender vehicle is configured for screening the particles of the divided materials of the asphalt mixture to classify into at least two groups comprising fine aggregates and coarse aggregates, or into three groups comprising fine aggregates, medium aggregates and coarse aggregates in accordance with particle sizes.

The present can include the feature wherein said measuring device contained in said blending device of said blender vehicle is configured for measuring each of groups classified into a plurality of groups of different particle size distributions in accordance with particle sizes.

The present invention can include the feature wherein said blender vehicle further includes a storing device for storing one or more unused groups of particles of different particle sizes in the plurality of groups, and for discharging them out of the motor-driven vehicle system.

The present invention can include the feature wherein said blender vehicle includes a receiving/transporting/discharging device for receiving, transporting and discharging the fresh asphalt mixture (new materials) from the receiving/transporting device of the miller vehicle under a temperature wherein re-aggregation of the loosened particulate materials can be prevented, said receiving/transporting/discharging device having a discharging section including two discharge ports arranged one after the other, one of said discharge ports located in front of the other discharge port being adapted to add said fresh asphalt mixture (new materials) to all or a part of the plurality of groups of different particle size distributions which has previously dispensed onto the road surface by the blender vehicle, said mixing device of the mixer vehicle being adapted to uniformly mix the materials added with the fresh asphalt mixture.

The present invention can include the feature wherein said mixer vehicle is further provided in front of the mixing device of the vehicle with a storing device such as a tank for storing fresh asphalt to be used as modifying agent, whereby the fresh asphalt to all or a part of the materials in the plurality of groups which has been dispensed onto the road surface by said blending device of said blender vehicle, said mixing device being adapted to mix them uniformly.

The present can include the feature wherein said blender vehicle is further provided, adjacent to said other discharge port located rearwards of said one discharge port of said receiving/transporting/discharging device of the vehicle, with mixing device such as a pug mill having an inlet and an outlet device, and between said mixing device and said blending device with a transporting device such as a conveyor for receiving, a part of the classified and measured materials in the plurality of groups of different particle size distributions and for transporting the materials to said mixing device, whereby said part of the classified and measured materials in the plurality of groups of different particle size distributions is introduced into said mixing device from an opening thereof and the fresh asphalt mixture (new materials) is added thereto to be uniformly mixed in said mixing device.

The present invention can include the feature wherein said blender vehicle further includes a storing device such as a tank for storing a supply of fresh asphalt as modifying agent in the vicinity of said mixing device of the vehicle, whereby the supply of fresh asphalt is added to a part of the plurality of groups which is being mixed in said mixing device.

The present invention can include the feature wherein said mixing device of said blender vehicle is configured to add a supply of the fresh asphalt mixture (new materials) and/or the fresh asphalt to a part of the plurality of groups of the classified and measured particles to uniformly mix them together to thereby provide a second regenerated asphalt mixture, said mixing device of the blender vehicle being further configured to add a supply of the fresh asphalt mixture (new materials) and/or fresh asphalt to all or a part of the remainder of the plurality of groups of the classified and measured particles to uniformly mix them together to provide a first regenerated asphalt mixture.

The present invention can include the feature wherein said mixer vehicle is further provided adjacent to said mixing device with two sets including a first set and a second set of spreading/compacting device such as two sets of augers and screeds, the first set of said spreading/compacting devices being configured for spreading and compacting said first regenerated asphalt mixture to form a first renewed asphalt mixture layer, the second set of said spreading/compacting device being configured for spreading and compacting said second regenerated asphalt mixture to form a second renewed asphalt mixture layer over said first renewed asphalt mixture layer, to provide a two-layered asphalt construction device.

The present invention can include the feature wherein said first renewed asphalt mixture layer is at least a dense graded asphalt mixture layer which is water impermeable.

The present invention can include the feature wherein said second renewed asphalt mixture layer is an open graded asphalt mixture layer which is water permeable.

BRIEF DESCRIPTION OF THE DRAWINGS

FIG. 11 is a blender vehicle in the preferred embodiment of the invention.

FIG. 12 is a mixer vehicle in the preferred embodiment of the invention.

BEST MODE OF CARRYING OUT THE INVENTION

With reference to FIGS. 7 to 12, a method and a motor-driven vehicle system for continuous on-site recycling of an asphalt mixture layer of a pavement will now be described in detail in accordance with a best mode of carrying out the invention.

Figure 7:
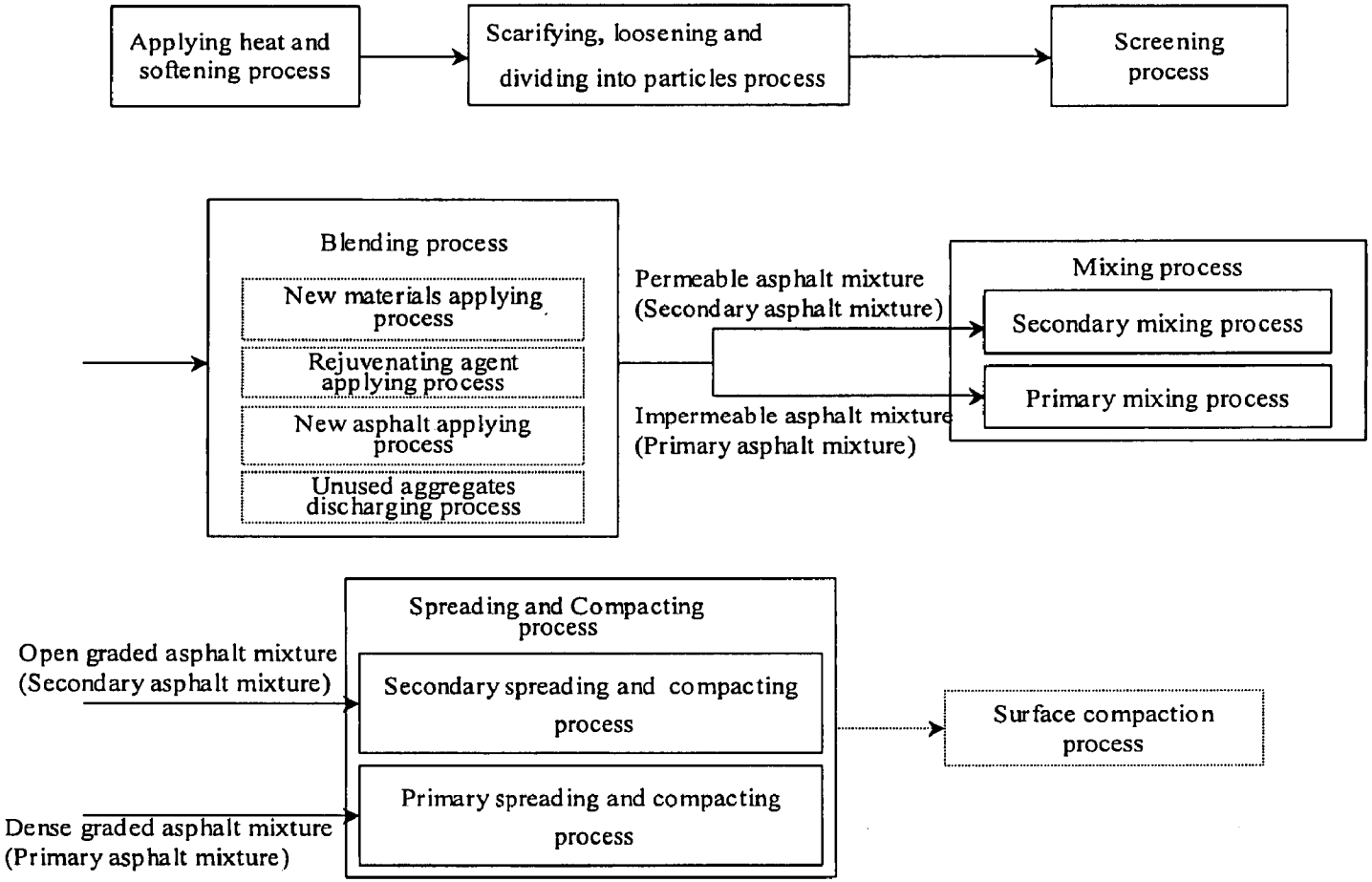
FIG. 7 is a sequence of processes in the method for continuous on-site recycling of an asphalt mixture layer of an existing pavement in the preferred embodiment of the invention.

FIG. 7 shows a sequence of processes in the method for continuous on-site recycling of an asphalt mixture layer of an existing pavement in accordance with a preferred embodiment, wherein the method comprises steps of: a) applying heat to the asphalt mixture layer to have it softened (hereinafter referred as "heat applying and softening step");b) scarifying and loosening materials of thus softened asphalt mixture layer to divide the materials into particles (also referred as "divided particulate asphalt mixture") under a temperature wherein re-aggregation of the loosened particulate materials can be prevented, to thereby provide particles of the divided materials of the asphalt mixture (also referred as "scarifying and loosening step"); c) screening the particles of the divided materials of the asphalt mixture (also referred as "regenerated aggregates") to classify into a plurality of groups of different particle size distributions in accordance with particle size (also referred as "screening step"); d) blending regenerated aggregates of different particle size belonging to the plurality of groups to provide a regenerated asphalt mixture having one or more particle size distributions appropriate for use in pavement (also referred as "blending step"); e) mixing uniformity the regenerated asphalt mixture (also referred as "mixing step"); and f) spreading and compacting the regenerated and uniformly mixed asphalt mixture over the road surface on which said steps a) and b) have been carried out to provide a renewed asphalt mixture layer on the road surface (also referred as "spreading and compacting step").

Among the aforementioned steps, the blending step may further include, steps of adding fresh asphalt mixture (also referred as "new materials") if necessary to the regenerated asphalt mixture which has been blended (also referred as "new materials adding step"), adding a rejuvenating agent such as softener if necessary to the regenerated asphalt mixture which has been blended (also referred as "rejuvenating agent adding step"), and adding fresh asphalt as modifying agent if necessary to the regenerated asphalt mixture to which the fresh asphalt mixture has been applied (also referred as "fresh asphalt adding step").

In accordance with the method of the present invention, any type of asphalt mixture layer of an existing pavement, such as a dense graded asphalt mixture layer, an open graded asphalt mixture layer or other type of an asphalt mixture layer can be recycled on road either into a dense graded asphalt mixture layer of one or two layer construction or into an open graded asphalt mixture layer, by properly classifying the scarified and loosened materials of the asphalt mixture, metering and blending the materials, and adding when necessary new material or materials, a rejuvenating agent such as softener, and/or fresh asphalt. In the case where an asphalt mixture layer of an existing pavement is to be recycled on road into a two-layer construction comprised of a water impermeable asphalt mixture layer and a water permeable asphalt mixture layer, the aforementioned mixing step may comprise steps of mixing uniformly a part of the regenerated and blended asphalt mixture to provide a first regenerated asphalt mixture comprising a water impermeable asphalt mixture layer (hereinafter referred as a "first mixing step"), and of mixing uniformly all or a part of the remainder of the regenerated and blended asphalt mixture to provide a second regenerated asphalt mixture for forming an open graded asphalt mixture layer (also referred as a "second mixing step").

Furthermore, the spreading and compacting step mentioned above comprises steps of spreading and compacting the first regenerated asphalt mixture to provide a water impermeable asphalt mixture layer (also referred as a "first spreading and compacting step"), and spreading and compacting the second regenerated asphalt mixture over the water impermeable asphalt mixture layer to provide an open graded asphalt mixture layer (also referred as a "second spreading and compacting step").

Figure 8:
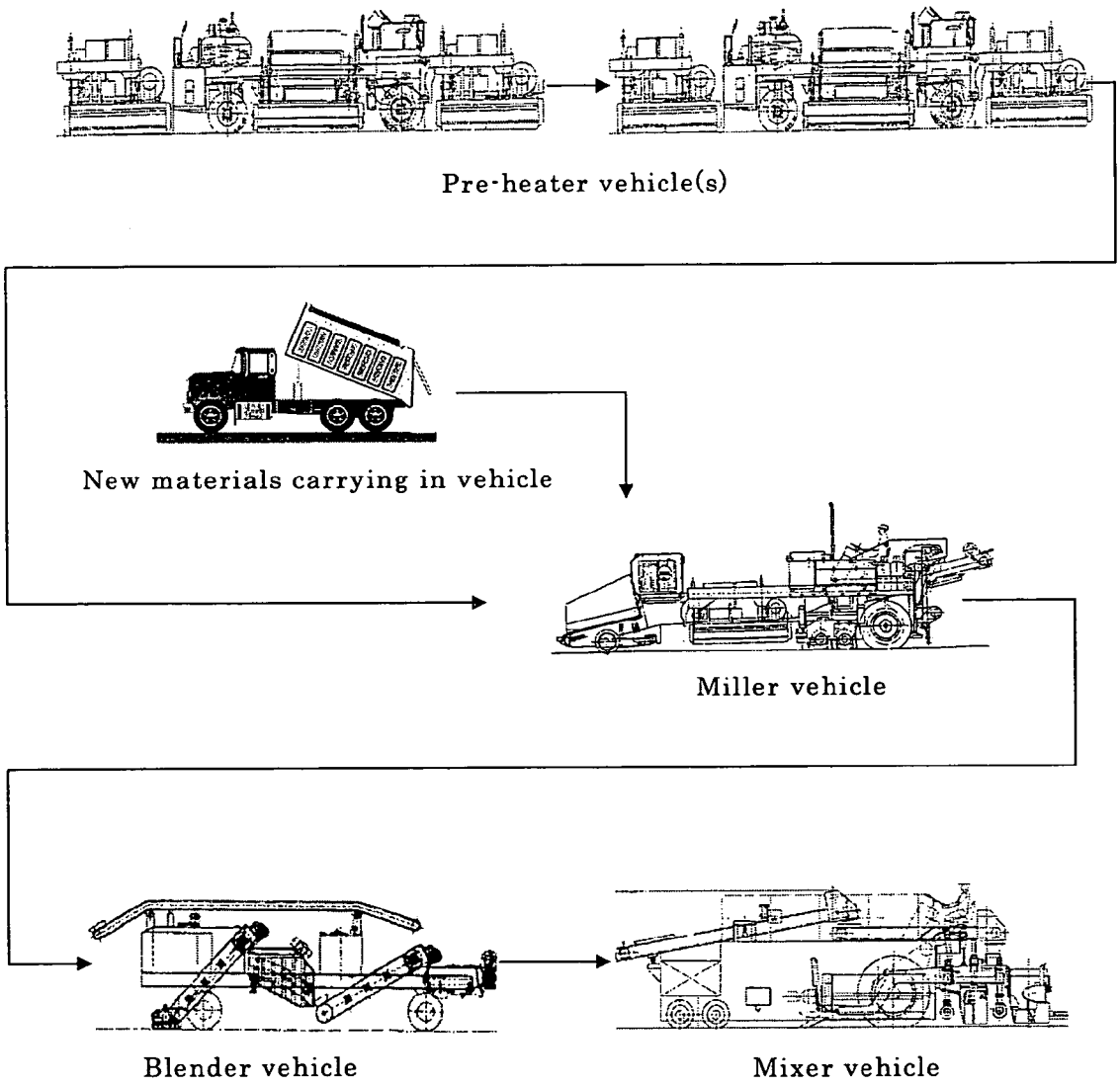
FIG. 8 is a motor-driven vehicle system for continuous on-site recycling of an asphalt mixture layer of an existing pavement in the preferred embodiment of the invention.

FIG. 8 shows an embodiment of an entire motor-driven vehicle system capable of carrying out the aforementioned steps in accordance with the method of the present invention, the motor-driven vehicle system comprising two pre-heater vehicles, a miller vehicle, a blender vehicle and a mixer vehicle. The on-site road surface recycling construction method according to the embodiment will now be described more specifically in conjunction with components and functions of each vehicle.

(Preliminary Property Analysis Prior to the Start of Recycling Steps)

To carry out the processes of the embodiment, material samples of asphalt mixture layers of an existing pavement subject to construction are taken prior to beginning those processes to analyze the density, the asphalt content, particle sizes of aggregates, the asphalt category, the penetration index and the softening point of the materials of the asphalt mixture. Concurrently; determination is made on the number of groups of different particle size distributions to be classified, the particle sizes of aggregates included in each of the plurality of groups, the content and the ratio of aggregates included in each group, the amount of new materials, the amount of a rejuvenating agent such as softener and the amount of fresh asphalt to be added as modifying agent, so that the renewed asphalt mixture layer meets required properties, and in the case where the regenerated asphalt mixture layer is intended to be a water drainable, open graded asphalt mixture layer, the resultant open graded asphalt mixture layer will have a desired water permeability factor.

(Pre-Heater Vehicle)

Figure 9:
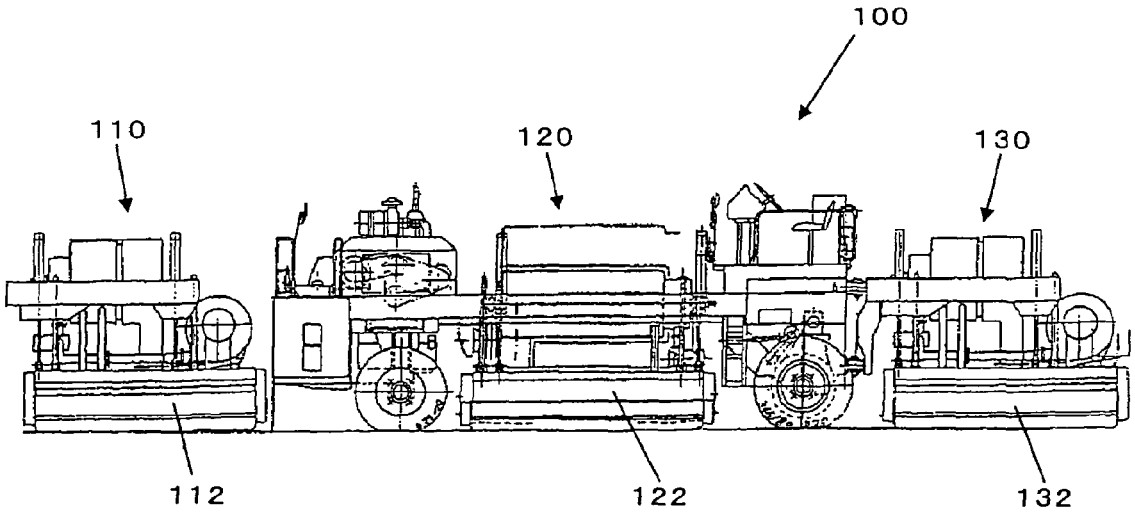
FIG. 9 is a pre-heater vehicle in the preferred embodiment of the invention.

FIG. 9 shows a pre-heater vehicle 100 in the preferred embodiment of the invention. The pre-heater vehicle 100 is a vehicle which carries out the heat applying and softening step as described with reference to FIG. 7. The embodiment uses two pre-heater vehicles 100. Each pre-heater vehicle 100 includes three heating devices 110, 120, and 130 for applying heat to the asphalt mixture layer of an existing pavement.

Figure 1:
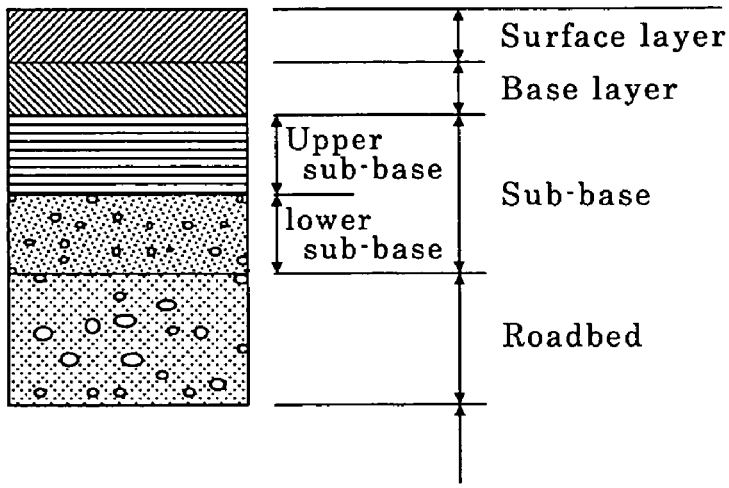
FIG. 1 is a longitudinal sectional view of a common asphalt pavement.
Figure 2:
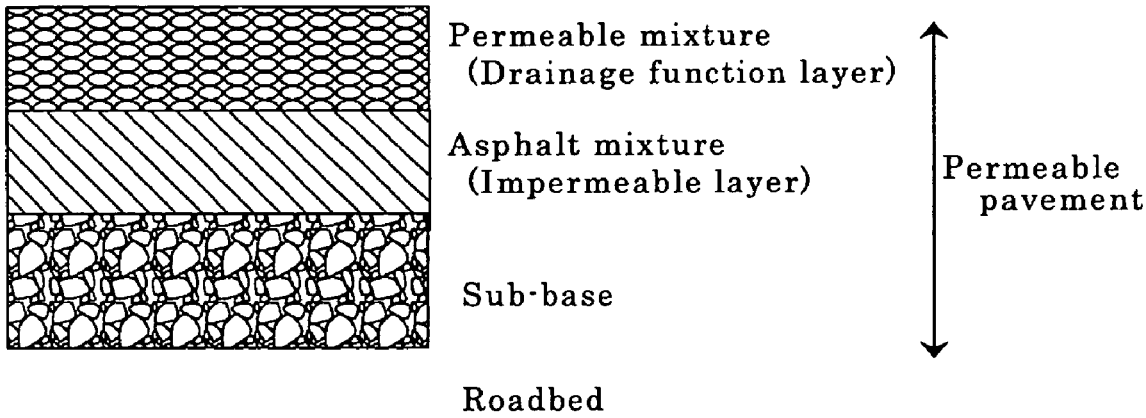
FIG. 2 is a longitudinal sectional view of a common drainable pavement.
Figure 3:
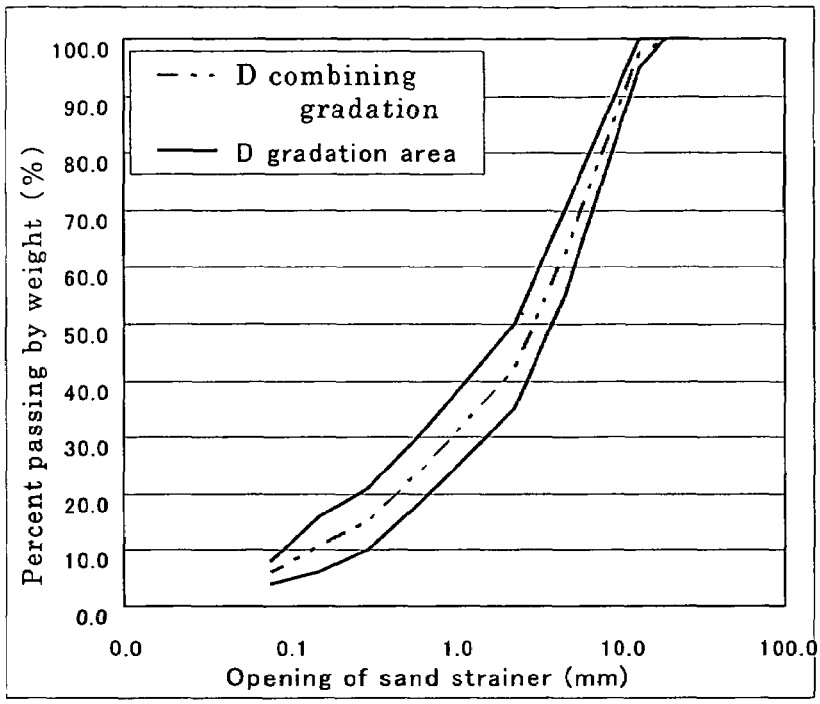
FIG. 3 is a particle size distribution graph of a dense graded, water impermeable asphalt mixture.
Figure 4:
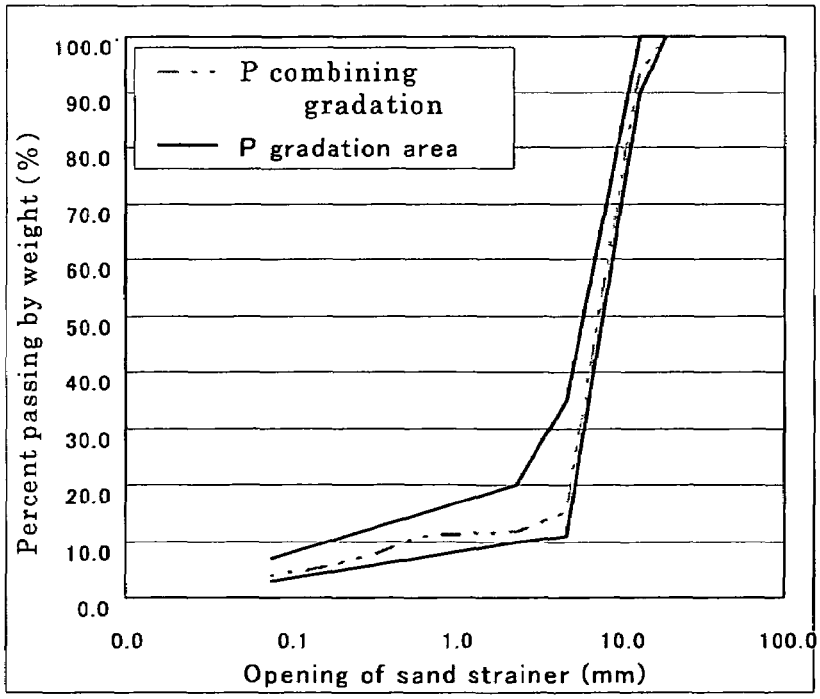
FIG. 4 is a particle size distribution graph of an open graded, water permeable asphalt mixture.
Figure 5:
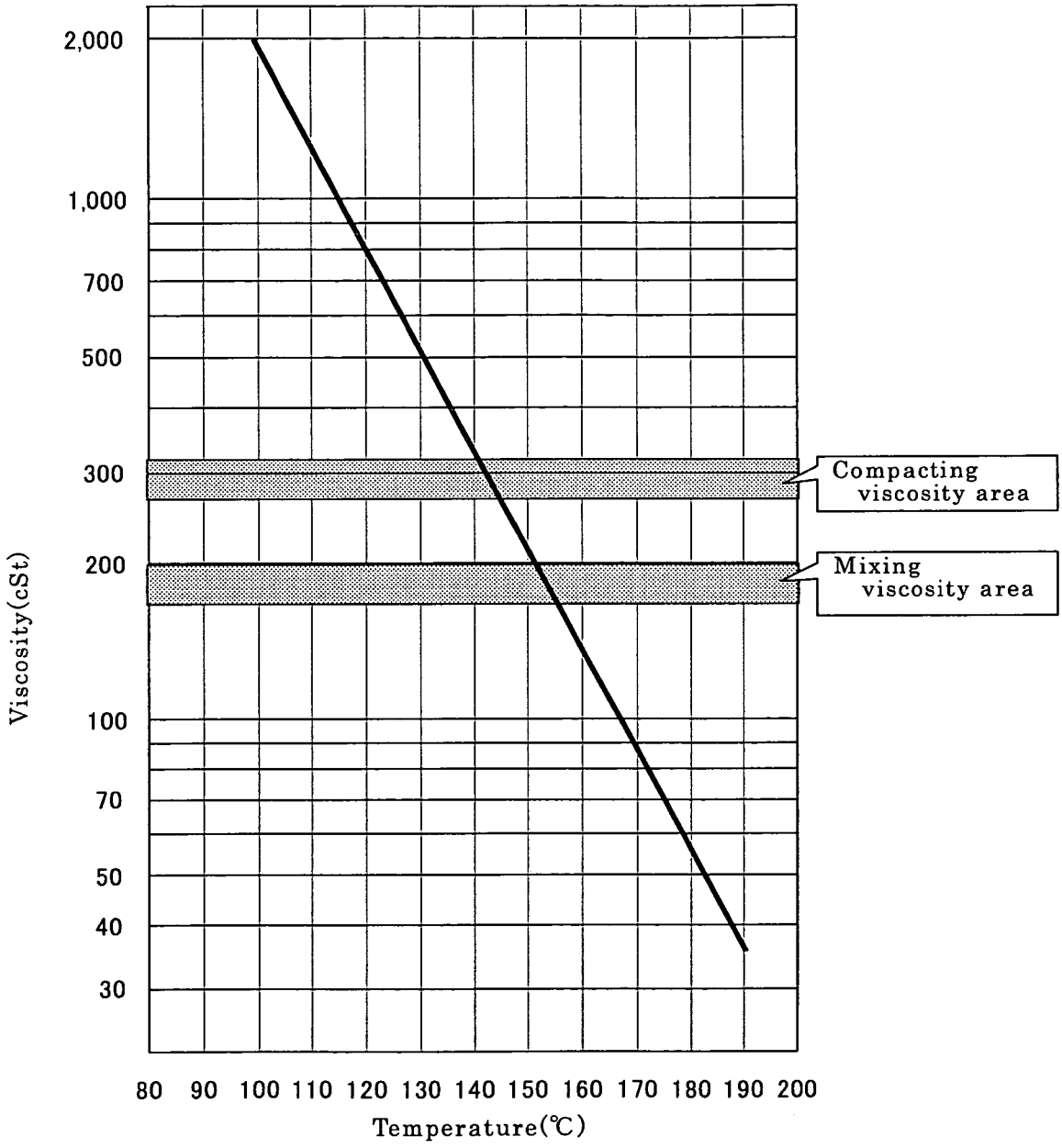
FIG. 5 shows the relationship between asphalt temperature and viscosity.
Figure 6:
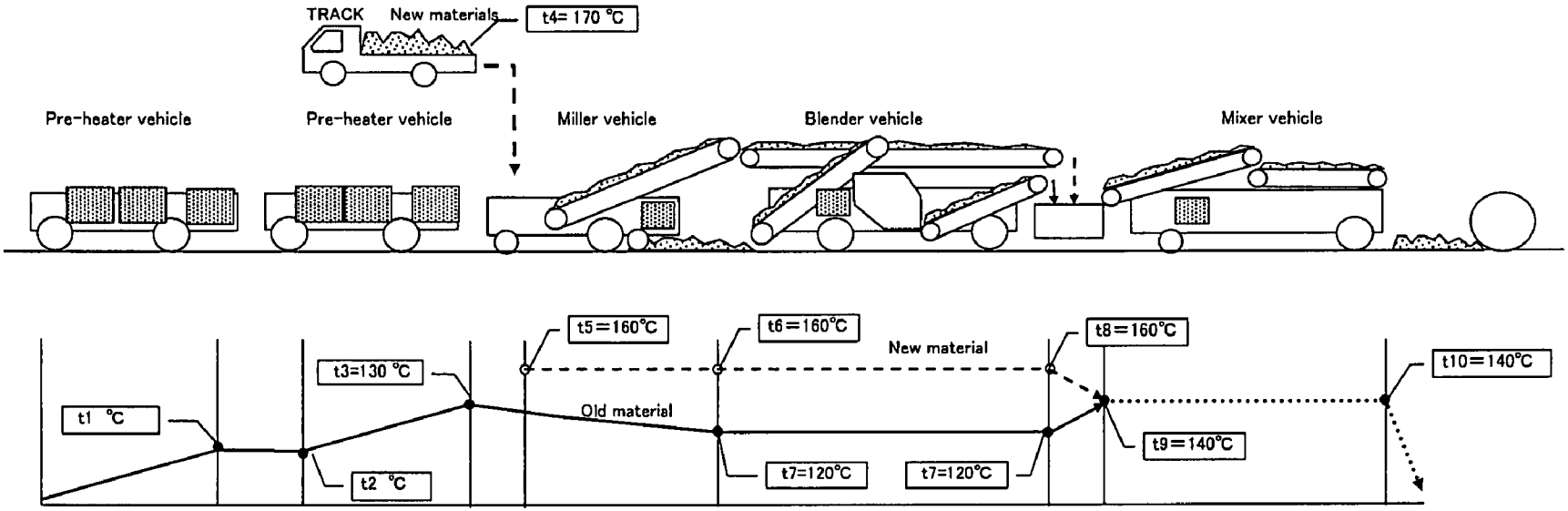
FIG. 6 shows a simulation result of an average asphalt temperature pattern.

One of the features of the present invention is that an asphalt mixture layer of an existing pavement may be scarified and loosened by means of a motor-driven vehicle system moved continuously along a road surface at a worksite, and then the materials of the scarified and loosened asphalt mixture can be screened on the road to classify the mixture into a plurality of groups of aggregates having predetermined, different aggregate size distributions by a screening device provided in a blending device 310 of a blender vehicle 300. However, the asphalt mixture as scarified and loosened is usually in the form of lumps wherein aggregates coated by asphalt are bonded together since the asphalt functions as a binder as described above, so that the materials in the asphalt mixture cannot pass properly through the mesh of the screening device in the blending device 310, and consequently the materials of the asphalt mixture cannot be classified into aggregates having desired particle sizes. Therefore, in order to have the materials of scarified and loosened asphalt mixture allowed to pass through the mesh of the screening device in an appropriate manner, it is necessary to maintain the scarified and loosened asphalt mixture (old materials) at a temperature of approximately 90 to 150 degrees Celsius, preferably 120 degrees Celsius, to thereby decrease the viscosity of asphalt in the mixture, so that the asphalt mixture is maintained at a temperature wherein the formation of lumps can be avoided and small particles can be formed (to form asphalt mixture in the state of particles ) as shown in FIG. 6.

The pre-heater vehicle 100 is provided with heating devices 110, 120, and 130 which are adapted to be disposed against the surface of an asphalt mixture layer in order to heat the asphalt layer up to the temperature required for separating aggregates into individual particles, and to facilitate succeeding scarifying and loosening step without any need of crushing aggregates included in the asphalt mixture layer. Each of the heating devices 110, 120 and 130 provided on the pre-heater vehicle 100 has a burner, heater beds 112, 122 and 132 provided beneath the heating devices 100, 120 and 130 and having a plurality of nozzles, and one or more blowers. Hot air heated by the burners 111, 121 and 131 is discharged from the plurality of nozzles at a temperature as determined in accordance with process conditions, for example from 500 to 700 degrees Celsius, preferably approximately 600 degrees Celsius. The plurality of nozzles are disposed in the heater beds 112, 122 and 132 so as to be placed against the surface of the asphalt mixture layer, with a spacing from the bottom ends of the plurality of nozzles to the surface of the asphalt layer being approximately 25 to 150 mm, preferably approximately 50 to 120 mm, most preferably approximately 70 to 100 mm. The length as measured in traveling direction of each of the heater beds 112, 122 and 132 in the heating devices 110, 120 and 130 may be approximately 3,000 mm. Hot air discharged from the plurality of nozzles impinges on the surface of the asphalt mixture layer, afterwards the hot air may be recycled by one or more of the blowers, then collected by the one or more blowers, and heated again by the burner to be discharged again from the plurality of nozzles.

The hot air from the plurality of nozzles is blown onto the surface of the asphalt mixture under a controlled traveling speed of the vehicle and a controlled temperature of the hot air, so that the surface of the asphalt mixture layer is maintained at a temperature less than 250 degrees Celsius, preferably less than 230 degrees Celsius, but the temperature at a depth of 40 mm below the surface of asphalt mixture layer is maintained greater than 60 degrees Celsius, preferably greater than 80 degrees Celsius. The hot air is thus blown onto the surface of the asphalt mixture layer under the controlled temperature as described above, so that it is possible to prevent the surface of the asphalt mixture layer from being burnt or overheated, but the surface of the asphalt mixture layer will be effectively heated to a temperature required for preventing the aggregates from being stuck together to form lumps and for having the aggregates separated into individual particles when the asphalt mixture is scarified and loosened by the miller vehicle, as described hereinafter, and further, the asphalt mixture layer can be effectively softened to facilitate scarifying and loosening the materials without causing crushing of aggregates in the asphalt mixture layer in a succeeding steps. A cover is provided over the plurality of nozzles of the heater beds 112, 122 and 132, so that hot air discharged from the plurality of nozzles and blown onto the surface of asphalt mixture layer, can be effectively collected by the blower with minimum leakage externally of the cover. Also it should further be noted that the arrangement for preventing leakage of hot air out of the cover is advantageous in that the process can be performed without any harmful effects on plants and the like in adjacent areas of a worksite along the road.

In the present embodiment, two pre-heater vehicles 100 are used, and each pre-heater vehicle 100 includes three heating devices 110, 120 and 130, respectively. The reason why such configuration is adopted is that heat is applied to the surface of the asphalt mixture layer intermittently but not continuously from the heating devices 110, 120 and 130 provided on a plurality of pre-heater vehicles, so that the applied heat is effectively conducted into the interior of the asphalt mixture layer while preventing both temperature decrease of and deterioration due to overheat of the surface of the asphalt layer. It should therefore be understood that any combination of number of pre-heater vehicles and heater devices may be adopted provided that the temperature of the portion at 40 mm below the surface of asphalt mixture layer can be effectively raised to a value greater than 60 degrees Celsius, preferably greater than 80 degrees Celsius simultaneously preventing temperature decrease of and deterioration due to overheat of the surface of the asphalt mixture, so that it is contemplated to effect modifications by providing for example more than two pre-heater vehicles each having only one heating device, or by providing one pre-heater vehicle with two or more heating devices.

It will be noted further that, in the present embodiment, the heating devices 110, 120 and 130 on the pre-heater vehicle 100 is of a type having a burner for producing a hot air flow which is to be blown onto the surface of the asphalt mixture layer. It should however be noted that heating devices of any type other than the hot air heaters, such as infra-red heaters, microwave heaters, direct flame heaters which apply fire flame directly onto the asphalt surface, or a combination of these heaters, as long as they are capable of appropriately applying heat to the asphalt mixture layer to be softened.

The working width with which hot air can be applied may be varied from 3,000 to 4,500 mm in a direction substantially perpendicular to the traveling direction of the pre-heater vehicle 100. In order to make the operative width variable, the structure may be such that the heater beds 112, 122 and 132 each having a plurality of nozzles are housed in the understructure of the pre-heater vehicle 100 in an extensible manner that these heater beds can be appropriately pulled out to accommodate for the working width. The way of varying the working width may be of a type other than the extensible structure, such as an attachment type wherein one or more heater beds each having a plurality of nozzles are adapted to be attached to a side or sides of the pre-heater vehicle or any other type which can vary the working width in accordance with the process conditions.

It should be noted that the motor-driven vehicle system being described herein is a system which is capable of moving at a speed of 4 to 5 m per minute as in the case of the AR2000 machine produced and distributed by the present inventor as mentioned above, so that each of the vehicles in the system is equipped with a driving device including a driving mechanism and a steering equipment and so on. However, the overall motor-driven vehicle system may be such that it can be towed in a trailer fashion by a tractor provided ahead of the pre-heater vehicle 100 and connected thereto. In this case, each vehicle of the system may not be provided with any facility such as power-motive device required for making the vehicle self-propelling device, and facilities which are to be provided on the vehicle may be mounted on a carriage to be carried thereon. Further, each of the vehicles of the motor-driven vehicle system may include a control system for controlling all or a part of the equipments mounted on each vehicle, so that the control system may control respective ones of the equipments mounted on the vehicle independently or simultaneously, however, the arrangements may be such that the vehicle system may not have such a control system but the equipments may be manually controlled independently or simultaneously.

(Miller Vehicle)

Figure 10:
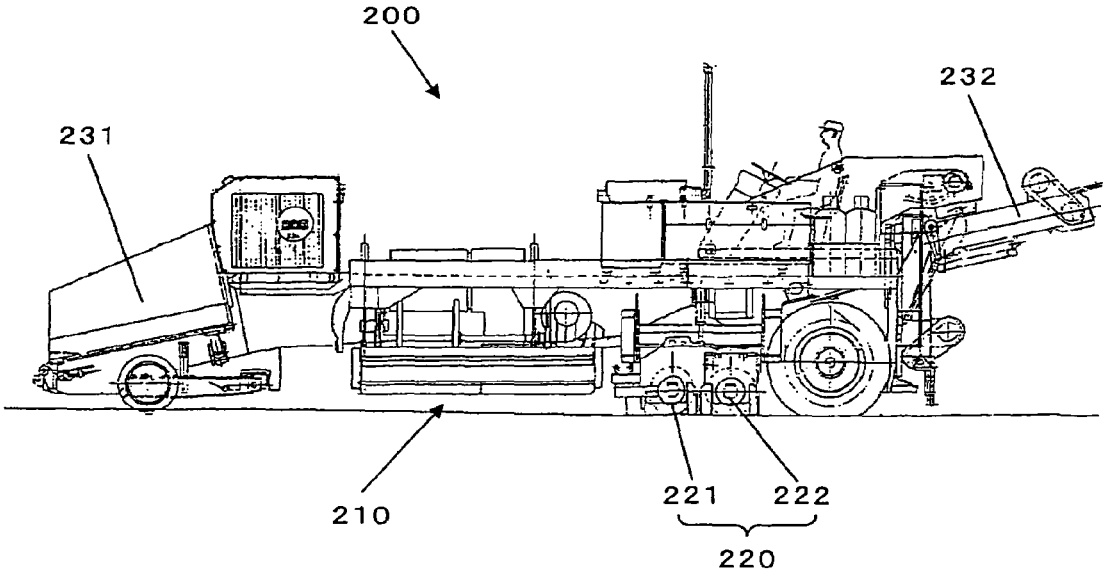
FIG. 10 is a miller vehicle in the preferred embodiment of the invention.
Figure 1:
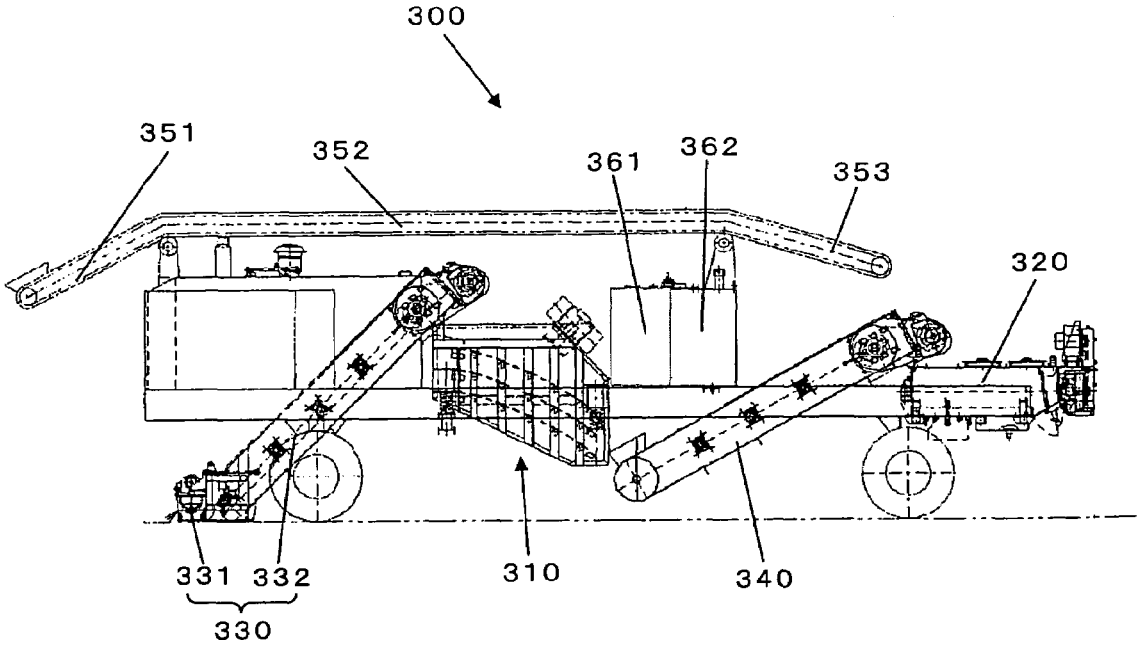
Figure 1:
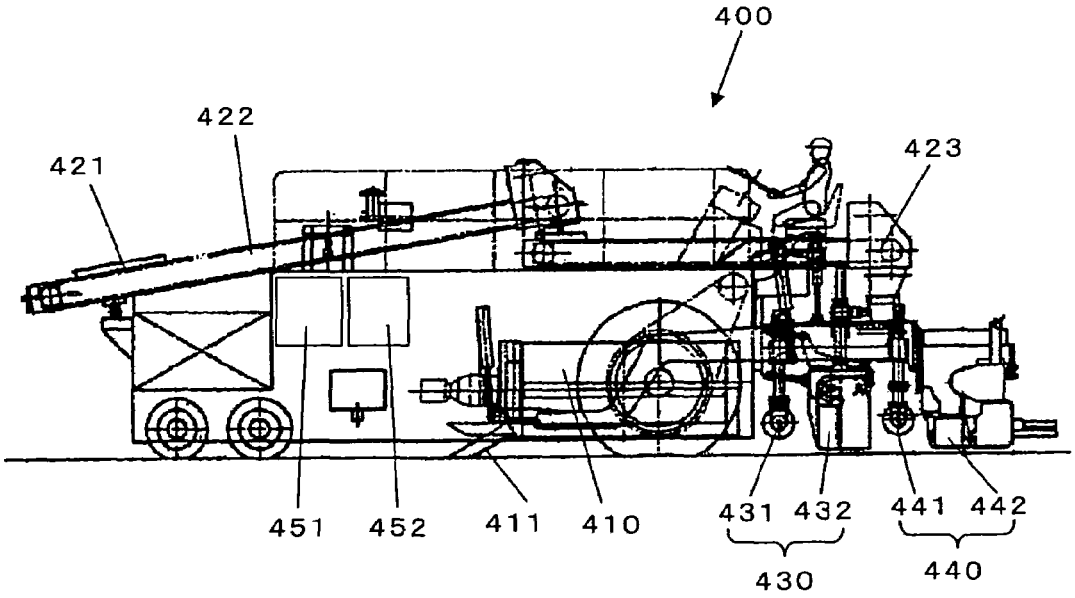

FIG. 10 shows the miller vehicle 200 in accordance with the preferred embodiment of the present invention. The miller vehicle 200 is a vehicle which is designed to carry out the process for scarifying and loosening materials of an asphalt mixture to be divided into particles as shown in FIG. 7. The miller vehicle 200 comprises a single heating device 210 which functions to heat further the asphalt mixture layer of the existing pavement which has been heated and softened by the pre-heater vehicle 100, two grinders 220 for scarifying and loosening the asphalt mixture layer which has been further heated by the heating device 210, and paired set of receiving/transporting devices 231 and 232 which are arranged to receive fresh asphalt mixture (hereinafter referred to as "new materials") supplied exteriorly of the motor-driven vehicle system, and transport the new materials to the blender vehicle 300 adjacent to the miller vehicle 200.

As described above, the asphalt mixture layer which has been heated and softened by the pre-heater vehicle 100 is scarified and loosened by the grinders 221 and 222 of the miller vehicle 200, then materials of the scarified and loosened asphalt mixture are screened to classify into a plurality of groups in accordance with particle sizes, and thereafter each of the classified groups is measured by a measuring device provided in a blending device 310 of the blender vehicle 300. In order to properly screen and classify materials of the asphalt mixture in accordance with sizes of particles of aggregate by the blending device 310, it is required that the temperature of the asphalt mixture transported to the blending device 310 should be 90 to 150 degrees Celsius, preferably 120 degrees Celsius. In the motor-driven vehicle system of the embodiment, the asphalt mixture layer to be scarified is heated in advance prior to the scarifying and loosening step by the heating device provided in the pre-heater vehicle 100 so that the temperature of the overall asphalt mixture is increased up to approximately the above mentioned temperature. However, since there is a certain distance between the pre-heater vehicle 100 and the miller vehicle 200, the surface temperature of the asphalt mixture layer may be decreased from the time when the asphalt mixture is heated by the pre-heater vehicle 100 to the time when it is scarified and loosened by the miller vehicle 200. Depending on the process conditions such as ambient temperature, it may happen that the surface temperature may significantly drop during this period of time even if the temperature of the inner portion of the asphalt mixture layer has been raised to the desired temperature, so that it mat become difficult under such situation to keep entire materials of the scarified and loosened asphalt mixture at a temperature wherein re-aggregation of the loosened materials can be prevented.

Therefore, in accordance with the embodiment, the miller vehicle 200 is provided at the front side of the grinder 221 with a heating device 210 which is disposed to be opposed to the surface of the asphalt mixture layer, so that the surface of the asphalt layer which has previously been heated by the pre-heater vehicle 100 is further heated to maintain the temperature of the asphalt mixture at a value wherein re-aggregation of materials of the asphalt mixture can be prevented. The heating device 210 of the miller vehicle 200 adopted in the present embodiment is of the same type as the heating devices 110, 120 and 130 in the pre-heater vehicle 100 and comprises a hot air flow type heater. It should however be noted that the heating device may be of other type such as for example an infrared heater, a microwave heater, a direct flame heater, or a combination of these heaters provided that it can maintain the temperature of the asphalt mixture at a temperature wherein re-aggregation can be prevented. The heating device 210 adapted to be disposed against the surface of the asphalt mixture layer may have a bottom face positioned with a space approximately 25 mm to 150 mm, preferably approximately 50 mm to 120 mm, most preferably approximately 70 mm to 100 mm from the surface of the asphalt mixture layer.

It may be that the could stop due to a trouble occurring in the system entirely or partially, and then the temperature of the asphalt mixture layer which has been heated by the pre-heater 100 may decrease rapidly in the case of a system failure due for example to a failure occurred in the whole or a part of the motor-driven vehicle system. In such case, even if the system is recovered and the process is started, it becomes impossible to maintain the temperature of the asphalt mixture layer at a value wherein re-aggregation of materials of the asphalt mixture can be prevented unless any means is provided. Under such circumstance, the heating device 210 of the miller vehicle 200 can function as an emergency heating device for rapidly raising the temperature of the asphalt mixture layer which has not been scarified and loosened.

In the present embodiment, the miller vehicle 200 is provided in front of the grinder 221 with the heating device 210, so that the asphalt mixture layer may be applied with heat until the time just before it is scarified and loosened so that its surface temperature can be maintained at the predetermined temperature. It should be noted, however, that the heating device 210 may be located rearward of the grinder 222 of the miller vehicle 200 so that the scarified and loosened materials of the asphalt mixture layer are maintained at a temperature wherein re-aggregation of the materials can be prevented. It should further be noted that, although only one heating device is provided on the miller vehicle 200 in the illustrated embodiment, two or more heating devices may be provided, if such arrangements are mechanically allowable.

The asphalt mixture layer which has been heated and softened by the pre-heater vehicle 100 and then heated again by the heating device 210 of the miller vehicle 200 is now scarified and loosened to a desired depth in accordance with the property of the road surface by activating two grinders 221 and 222 at a cutting speed in compliance with the moving speed of the motor-driven vehicle system. By scarifying the asphalt mixture layer at a surface temperature of approximately 230 degrees Celsius and an inside temperature at 40mm below the surface of the asphalt mixture layer of nearly 80 degrees Celsius, the entire materials of the asphalt mixture layer are maintained at a temperature of approximately 90 to 150 degrees Celsius, preferably approximately 120 degrees Celsius wherein re-aggregation can be prevented, thus providing an asphalt mixture comprising individually divided or separated aggregates or particles. Although drum cutters are shown as grinders 221 and 222 in the embodiment, it is possible to use other types of devices capable of scarifying and loosening the asphalt mixture layer in a range up to a predetermined depth and a predetermined width for cutting the layer at a predetermined speed. The width for cutting the asphalt mixture layer can be adjusted from approximately 3,000 mm to approximately 4,500 mm by extending and contracting the grinders 221 and 222 in axial directions of the grinders, using the mechanism as adopted in the AR2000 of a motor-driven vehicle system manufactured and distributed by the present inventor.

Although two grinders 221 and 222 are mounted in the longitudinal direction of the miller vehicle 200 in the present embodiment, only a single grinder may be adopted provided that a desired cutting depth, width and speed can be ensured, or alternatively, three or more grinders may also be adopted if the desired cutting depth, width and speed cannot be ensured by only two grinders. Furthermore, the materials of the asphalt mixture which has been scarified and loosened by the grinders 221 and 222 may be gathered and piled up along a center line of the road surface to form a ridge to facilitate succeeding processes, and in such case, provisions may be made rearwards of the grinder 222 such as a scraper blade for gathering the scarified and loosened materials of asphalt mixture.

According to the method of the present invention, in order to provide a proper conditioning of the regenerated asphalt mixture in respect of particle sizes of aggregates, asphalt content, strength and other properties in the asphalt mixture, a supply of fresh asphalt mixture (new materials) may be added to materials of the asphalt mixture of the existing pavement to provide a regenerated asphalt mixture. In the illustrated embodiment, the new materials may be supplied to the motor-driven vehicle system by loading the new materials from an out-of-the-system loading vehicle such as a truck which has been loaded with the new materials and which can be associated with the system, and when the truck is emptied, the empty truck is moved apart from the system and another truck having the new materials loaded thereon is again associated with the system. The vehicle having the new materials loaded thereon may preferably be connected with the system at a position where the asphalt mixture layer has not yet been scarified by the grinders 221 and 222, that is, a position in front of the miller vehicle 200, so that the scarified asphalt mixture will not receive any adverse effect from the loading vehicle. Thus, the miller vehicle 200 is provided with the aforementioned paired receiving/transporting devices 231 and 232 for receiving the new materials at the front end portion of the miller vehicle 200 from the loading vehicle, transporting the received new materials to the rear end portion of the miller vehicle 200 to give the new materials to the blender vehicle 300 following the miller vehicle 200. The new materials thus transported to the motor-driven vehicle system will be added to the scarified materials by means of the mixing device 320 provided in the blender vehicle 300 which is following the miller vehicle 200 and/or on the road surface.

In the present embodiment, the receiving section 231 of the paired receiving/transporting devices 231 and 232 comprises a hopper provided at the front portion of the miller vehicle 200. The new materials received by the receiving section 231 is transported to the blender vehicle 300 through the transporting device 232 which comprises a transporting section contiguous with the receiving section 231 for receiving the new materials from the receiving section 231, and a transferring section disposed for transferring the new materials to the succeeding blender vehicle 300. In the embodiment, the transporting device 232 is embodied as a belt conveyor, however, any devices other than a belt conveyor, such as a bar feeder, a slat conveyor, a screw conveyor or the like may also be used, as long as they are capable of receiving the new materials from the receiving section 231 and transferring them to the succeeding blender vehicle 300.

It is preferable, for the purpose of maintaining the new materials at a temperature wherein formation of lumps can be prevented until the new materials are added to the asphalt mixture in the succeeding process, to provide the transporting device 232 with a warming device for maintaining the transported new materials at a temperature between approximately 140 and 180 degrees Celsius, preferably at approximately 160 degrees Celsius. The warming device may include a cover encompassing the entire portion of the transporting device 232 and a simple burner for warming the new materials while they are transported on the transporting device 232, but any other means may be adopted such as an electric heater arranged to heat the new materials being transported by the transporting device. It should be noted that the illustrated vehicle system is provided with various transporting devices including the aforementioned transporting device 232 for the new materials, as well as a device 232 for transporting the scarified asphalt mixture, and a device 340 for transporting the classified aggregates and the like, and heating devices may be provided all or a part of these transporting devices so that the materials being transported are appropriately warmed.

In the embodiment described above, the receiving section 231 is located at the front portion of the miller vehicle 200 so that the new materials are received at the receiving section 231 from the loading vehicle such as a truck connected with the front portion of the miller vehicle 200. It should however be noted that loading vehicle for the new materials may not be connected with the motor-driven vehicle system but the loading vehicle may be moved along with the motor-driven vehicle system and the new materials are transferred to the receiving section 231 of the miller vehicle 200 from the loading vehicle. Further, the receiving section 231 for the new materials may not necessarily be positioned at the front portion of the miller vehicle 200, but may instead be positioned at the front portion of the blender vehicle 300, or at a side portion of either the miller vehicle 200 or the blender vehicle 300 so that the new materials may be transferred to the motor-driven vehicle system from the loading vehicle while the loading vehicle is moved along with the motor-driven vehicle system.

(Blender Vehicle)

FIG. 11 shows the blender vehicle 300 in accordance with a preferred embodiment of the present invention. The blender vehicle is designed for carrying out the screening process, the blending process, and the secondary mixing process, and in addition, when desired, new materials adding process, the rejuvenating agent adding process, and/or the fresh asphalt adding process as shown in FIG. 7. The blender vehicle 300 is provided with a set of scooping/transporting devices 330 for scooping and transporting the asphalt mixture comprising individually divided particles of aggregates which have been scarified and maintained at a temperature wherein re-aggregation of the materials can be prevented, a blending device 310 contiguous with the scooping/transporting devices 330 and including a screening device for screening the asphalt mixture of individually divided particles of aggregates to classify the particles into three groups of different particle size distributions and a measuring device for measuring each group of the classified particles of aggregate (hereinafter referred as "regenerated aggregates"), if necessary, a single mixing device 320 for mixing uniformly a part of the blended particles of aggregate with new materials, a rejuvenating agent such as softener, and/or fresh asphalt as modifying agent which are to be added as required, and a transporting device 340 contiguous with the blending device 310 for transporting a part of the blended and regenerated aggregates to the mixing device 320.

The blender vehicle 300 is further provided with a set of receiving/transporting/discharging device 351, 352, and 353 contiguous with the transporting device 232 of the miller vehicle 200 for receiving the new materials from the transporting device 232, transporting the received new materials to a portion above the mixing device 320 of the blender vehicle 300 and discharging the new materials through an opening provided in the upper portion of the mixing device 320, a reservoir 361 and 362 for a rejuvenating agent such as softener to be added to the secondary regenerated asphalt mixture, and a reservoir 362 for the fresh asphalt to be used as modifying agent. It is preferable that the blender vehicle 300 includes a set of storing devices and a transporting device for storing unused portions of regenerated aggregates which have been screened and classified by the screen device of the blending device 310 into groups of different particle sizes, and for discharging the unused portions of regenerated aggregates out of the motor-driven vehicle system.

The materials of asphalt mixture is placed on the road surface at the time when they have been scarified and loosened by the miller vehicle 200, and is maintained at a temperature of approximately 90 to 150 degrees Celsius, preferably approximately 120 degrees Celsius for preventing the materials from being re-aggregated to form lumps. The divided particles of materials of asphalt mixture on the road surface are then scooped by the scooping device 331 mounted on the front portion of the blender vehicle 300, and transferred to the transporting device 332 contiguous with the scooping device 331 to be transported to the inlet of the screening device of the blending device 310 located adjacent to the transporting device 332. In the embodiment, an auger and a slat conveyor adjacent to the auger are provided at the front portion of the blender vehicle 300 as parts of the scooping/transporting device 330 to reliably scoop up the divided particles of the materials of asphalt mixture. The auger has an additional function of further agitating the divided particles of the materials of asphalt mixture, and with this agitation the materials are further maintained at a temperature sufficient to prevent formation of lumps. It should be noted that the scooping/transporting device 330 may be of any type other than the aforementioned auger, the slat conveyor and other type of conveyor, provided that a device capable of reliably scooping up the divided particles of the materials of asphalt mixture on a road surface and transporting the scooped materials to the inlet of the screening device of the blending device 310.

In the case where it is intended to reconstruct an existing pavement having a water impermeable asphalt mixture layer into the one having an open graded, water permeable asphalt mixture layer, the following processes are used. First, the materials of asphalt mixture are scarified from an existing pavement and divided into particles, and while they are maintained at a temperature sufficient to prevent formation of lumps, they are screened by means of the aforementioned screening device so that they are classified into three groups of different particle size distributions in accordance with particle sizes of aggregates, e.g., into a group of aggregates having particle sizes less than 5 mm in diameter (hereinafter referred to as "regenerated fine aggregates"), aggregates having particle sizes between 5 mm and 13 mm in diameter (also referred to as "regenerated medium aggregates"), and aggregates having particle sizes between 13 mm and 20 mm in diameter (also referred to as "regenerated coarse aggregates"). Then, a first regenerated asphalt mixture for constructing a lower structure of a regenerated asphalt mixture layer is provided from metered quantities of the regenerated materials comprising two of the aforementioned three groups, specifically, from the regenerated fine aggregates and the regenerated coarse aggregates, by adding to these regenerated aggregates, as necessary, new materials, a rejuvenating agents such as a softener, and/or fresh asphalt which is added as a modifying agent, and then uniformly mixing the materials. As already described, the first regenerated asphalt mixture comprises a quantity of the regenerated fine aggregates and a quantity of the regenerated coarse aggregates, and in the mixture, the ratio in weight of the regenerated coarse aggregates to the regenerated fine aggregates is low, for example less than about 30%, so that the mixture provides a water impermeable asphalt mixture wherein void spaces in the coarse aggregates are substantially filled by the fine aggregates to provide a low void ratio. Further, a metered quantity of the classified regenerated medium aggregates among the regenerated aggregates are used to provide a second asphalt mixture for use as a surface layer in an asphalt mixture layer of a two-layer construction, by adding to these medium aggregates, as necessary, new materials, a rejuvenating agent such as a softener, and/or fresh asphalt which is added as a modifying agent, and uniformly mixing these materials. The second asphalt mixture does not contain the fine aggregates, so that the particle size distribution is such that gaps are produced between particles of aggregate to provide open graded asphalt mixture. Thereafter, the first asphalt mixture is spread and compacted over the road surface, and then the second asphalt mixture is spread and compacted over the first asphalt mixture layer to finally provide an asphalt mixture layer of a water permeable property.

The blending device 310 provided on the blender vehicle 300 is thus designed in order to provide materials of asphalt mixture for forming a water permeable asphalt mixture layer with the described processes, to accomplish blending by classifying the divided asphalt mixture into the aforementioned three groups of particle distributions in accordance with results of previously performed property analysis, and metering the classified materials. In the embodiment, the blending device 310 comprises a screening portion including three types of screening devices having different screen mesh sizes respectively and a vibration mechanism for vibrating the screening devices, a metering portion including a metering device for metering each of the regenerated aggregates classified by the screening portion, and a cleaner for cleaning clogged screen meshes. The screening portion is a device for screening the divided materials of asphalt mixture under the aforementioned re-aggregation-suppressing temperature, to classify into three groups of different particle size distributions in accordance with particle sizes, e.g. into the aforementioned regenerated fine aggregates, the regenerated medium aggregates, and the regenerated coarse aggregates, by means of the three types of the screening devices, wherein the entire screening devices are associated with a vibrator so that they are vibrated by the vibrator. Each of the three types of screening devices is slanted and the three screening devices are arranged in a multistage construction with a slope comprising a first screen mesh in upper fashion, so that the screen device having a coarser mesh size is located below the screen device of a finer mesh. The three types of screening device are of mesh sizes of 13 mm, 10 mm and 5 mm, respectively, and arranged in this order from top to the bottom. The divided particles of asphalt mixture are introduced into the inlet of the screening portion and classified at first into aggregates having particle size greater than 13 mm in diameter and aggregates having particle size smaller than 13 mm in diameter by the first one of the screen devices. The aggregates having particle size greater than 13 mm in diameter trapped by the first screen device constitute the regenerated coarse aggregates. Then, the aggregates of the size smaller than 13 mm in diameter which have passed through the first screen device are screened by the by the second screen device to be classified into aggregates of the size greater than 10 mm and aggregates of the size smaller than 10 mm in diameter. The aggregates smaller than 10 mm in diameter which have passed through the second screen device are then screened by the third screen device to be classified into aggregates of particle size greater than 5 mm and aggregates smaller than 5 mm. The aggregates which have not passed through the second and third screen devices constitute the regenerated medium aggregates. It should be noted that, in principle, two types of screen devices having mesh sizes of 13 mm and 5 mm in diameter may be sufficient to classify the materials of asphalt mixture into three groups of different particle size distributions as described above, however, in an arrangement wherein the aggregates smaller than 13 mm in diameter are screened only by one 5 mm mesh screen device for classifying them into those greater than 5 mm and those smaller than 5 mm, an excessive load will be incurred on the screen device, so that adhesion of the asphalt materials to the screen device will rapidly increased making it difficult to carry out an appropriate classification. Thus, in the present embodiment, the 10 mm mesh screen device is additionally provided between the 13 mm mesh screen device and the 5 mm mesh screen device to share the load on the screen devices. Finally, the aggregates which have passed through the third screen device constitute the regenerated fine aggregates. The materials which have passed through the third screen device contain low viscosity fluidized asphalt from the scarified pavement in addition to the aggregates of smaller than 5 mm in diameter. The screening capacity of the screening portion may be varied in accordance with the traveling speed (operating speed) of the motor-driven vehicle system. The regenerated fine aggregates, the regenerated medium aggregates and the regenerated coarse aggregates which have been classified at the screening portion are then metered at the measuring portion of the blending device 310, and blended .

It should be noted that the scarified and loosened materials of asphalt mixture can be screened only when they are maintained at the temperature of approximately 90 to 150 degrees Celsius, preferably approximately 120 degrees Celsius wherein re-aggregation can be prevented. It may however be feasible that an additive may be added to the scarified and loosened asphalt mixture for making the mixture more lubricious, so that the mixture can be more readily passed through the screen devices with a decreased friction between the screen devices and the mixture due to the modified lubricity.

In the present embodiment, three screens are used to classify the materials of asphalt mixture into the aforementioned three groups of aggregates of different particle. It should however be noted that this is simply an illustration of a preferred implementation, and that the present invention is not limited to a particular number of groups to be classified, but the number of screens may be changed as desired so as to make it possible classify the scarified asphalt mixture into any number of groups of different particle size to provide classified groups which will allow blending of materials suitable for forming a resultant asphalt mixture layer of a desired quality. For example, only one screen may be used to classify the scarified materials of asphalt mixture into two groups of different particle sizes, such as the regenerated fine aggregates and the regenerated coarse aggregates, and use the regenerated fine aggregates to provide the aforementioned first asphalt mixture, and to use the regenerated coarse aggregates to provide the second asphalt mixture alternatively, three or more screens may also be employed to classify the scarified materials of asphalt mixture into four or more groups of regenerated aggregates in accordance with particle sizes, which may then be blended to form an asphalt mixture of a desired property.

It should further be note that, although in the embodiment described above, three groups of different particle size distributions are respectively comprised of particles less than 5 mm, particles greater than 5 mm but less than 13 mm, and particles greater than 13 mm, this embodiment is also a preferred example of the invention, so that the invention is not limited to such specific values of particle sizes, but modifications may be made by changing the mesh sizes of the respective screens to thereby obtain regenerated aggregates having particle sizes different from those of the aforementioned embodiment.

The scarified asphalt mixture to be screened is heated so that the asphalt therein has a decreased viscosity, however, through a prolonged use of the screens, the asphalt mixture tends to adhere gradually to and clog the meshes of the screens causing a reduction in the capacities of the screens. In order to suppress such reduction in the screen capacities, it is preferable to provide the, blending device 310 with screen cleaners for cleaning the clogged screens. Each of the screen cleaners may include one or more bars mounted on the surface of each screen by being suspended by wires so that the bars hit against the screen surface under the vibration of the screen meshes to thereby eliminate such possible clogging, however, the invention is not limited to such type of device but may include another type, such as a device with a brush mounted for a swinging movement on the screen for preventing clogging. Although the screening mechanism in the embodiment includes a vibrating screening device, any other type of mechanism may be adopted provided that it can classify the scarified asphalt mixture with a desired quality.

Among the three groups of regenerated aggregates classified in accordance with particle sizes by the screening portion of the blending device 310, the regenerated fine aggregates and the regenerated coarse aggregates are metered by the measuring device, and then discharged from the lowest side of the blending device 310 to the road surface. The regenerated fine aggregates and the regenerated coarse aggregates placed on the road surface are then introduced into the mixing device 410 through a front inlet 411 of the mixing device 410 provided in the mixer vehicle 400 following the blender vehicle, and additionally supplied, as necessary, with new materials, a rejuvenating agent and/or fresh asphalt, which are uniformly mixed with the aforementioned fine and coarse aggregates to form the first regenerated asphalt mixture. According to the described embodiment the regenerated fine aggregates and the regenerated coarse aggregates adapted to form the first asphalt mixture layer are transferred by way of the road surface to the mixing device 410 of the mixer vehicle 400, however, it should be noted that a transfer device may be provided contiguous with the blending device 310 of the blender vehicle 300, and another separate transfer device may be provided contiguous with the mixer vehicle 400 so as to transport the regenerated aggregates to the mixing device 410.

In the three types of regenerated aggregates classified into three groups in accordance with particle sizes by the screening portion of the blending device 310, a metered quantity of the regenerated medium aggregates is provided by the measuring device, and then discharged from a rearward portion or a lower portion of the blending device 310. The discharged regenerated medium aggregates are transported to the upper portion of the mixing device 320 of the blender vehicle 300 by the transporting device 340 contiguous with the blending device 310 to be introduced into an opening provided in the upper portion of the mixing device 320, whereupon the aggregates are mixed uniformly to form the second regenerated asphalt mixture. The transporting device 340 in the illustrated embodiment is shown as being comprised of a belt conveyor, however, other type of device, such as a bar feeder, a slat conveyor or screw may also be employed provided that they are capable of transporting the regenerated medium aggregates to the inlet opening of the mixing device 320 of the blender vehicle 300 at a desired speed. It should further be noted that, according to the illustrated embodiment, the mixing device 320 is comprised of a pug mill mixer for providing the second regenerated asphalt mixture, however, any other type of mixers may also be employed as the mixing device 320 as long as such mixers can mix uniformly the regenerated medium aggregates with, if any, new materials, the rejuvenating agent such as softener and/or fresh asphalt as modifying agent. Alternatively, in another embodiment of the present invention, the inlet opening of the mixing device 320 may not necessarily be provided in the upper portion but may be provided at a front or side portion of the device.

In the embodiment, the first regenerated asphalt mixture is provided by uniformly mixing the regenerated fine aggregates and the regenerated coarse aggregates, however, the first asphalt mixture may be provided solely from the regenerated fine aggregates by using all or only a part of the regenerated fine aggregates among the two groups of particle size distributions. In such a case, the unused regenerated coarse aggregates and the unused remaining part of the regenerated fine aggregates may be discharged out of the motor-driven vehicle system to be used for other purposes, alternatively, or may be used as aggregates for the second regenerated asphalt mixture. Further, in accordance with the embodiment, the second regenerated asphalt mixture is provided from the regenerated medium aggregates, however, it should be appreciated that the regenerated coarse aggregates can be used rather than the regenerated medium aggregates for the same purpose.

The mixing device 320 of the blender vehicle 300 and the transporting device 340 for transporting the regenerated medium aggregates discharged from the blending device 310 to the inlet opening of the mixing device 320, may not necessarily be used in the case where two layer structure is not required for the renewed asphalt mixture layer, such as the case where a dense graded asphalt mixture layer, an open graded asphalt mixture layer or other asphalt mixture layer in an existing pavement is scarified and loosened, and such scarified materials of the asphalt mixture are used wholly of partly for blending to provide materials for a single layer regenerated asphalt mixture structure. In such cases, the regenerated aggregates are discharged from the blending device 310 onto the road surface after being classified as necessary and thereafter metered, and the aggregates on the road are then used by the mixing device 410 of the mixer vehicle 400 by being mixed uniformly with new materials which may be added as necessary, rejuvenating agents and/or fresh asphalt, for providing a single type of asphalt mixture.

In this process, the second regenerated asphalt mixture may be added with a supply of fresh asphalt mixture (new materials) based on the results of a preliminary analysis for material properties, in order for an adjustment of particle size and strength of the second regenerated asphalt mixture, or for providing the second regenerated asphalt mixture with an additional functional feature. The new materials are transported to the rear portion of the miller vehicle 200 by the transporting device 232 mounted on the miller vehicle 200. The blender vehicle 300 may further be provided with a new material receiving device 351 contiguous with the transporting device 232 , a new material transporting device 352 extending from the front portion through the upper portion to the rear portion of the blender vehicle 300, and a discharging device 353 disposed at the rear end portion of the transporting device 352 for discharging the new materials transported by the new material transporting device 352. The new materials are discharged from the discharging device 353, and introduced into the mixing device 320 mounted beneath the discharging device 353. In the embodiment, the new material receiving/transporting/discharging devices 351, 352 and 353 of the blender vehicle 300 are comprised of belt conveyors, it should however be noted that other types of devices such as bar feeders, slat conveyors or screw conveyors may also be employed as long as the new materials can be transported to the mixing device 320 at a desired speed.

In the above embodiment, the new materials are added to the second regenerated asphalt mixture, however, new materials may also be added to the first regenerated asphalt mixture as well, for the purpose of adjustment of the particle size and the strength of the first regenerated asphalt mixture, or for providing the first renewed asphalt mixture layer with a additional functional feature. In the case where the renewed asphalt mixture layer is not required to be of a two-layer structure, the new materials may be added only to the regenerated aggregates discharged from the blending device 310 onto the road. As a provision for such cases, an additional discharging device may be provided in the blender vehicle 300 at an intermediate portion of the new material transporting device 352 for discharging all or a part of the new materials being transported by the transporting device 352 so that the new materials are added to the regenerated aggregates discharged from the blending device 310 onto the road.

In addition to the new materials, the regenerated medium aggregates may be added with a rejuvenating agent such as softener and/or fresh asphalt as modifying agent based on the results of a preliminary analysis on material properties. A rejuvenating agent may be added for the purpose of adjusting the penetration value of asphalt mixture or restoring the properties of used asphalt, and the fresh asphalt may be added for the purpose of adjusting the strength of the asphalt mixture, or prevent aggregates from being scattered. There are two types of rejuvenating agents, namely, an emulsion type and an oil type, the properties required being shown in page 221 of Non-patent literature 1. In the embodiment, the blender vehicle 300 is provided at the rearward portion of the blending device 310 with a reservoir 361 for the rejuvenating agent and a reservoir 362 for the fresh asphalt. The rejuvenating agent and/or the fresh asphalt stored in the reservoir 361 and 362 respectively may be added to the regenerated medium aggregates being transported on the transporting device 340 for transporting the regenerated medium aggregates through respective pipes extending from the respective reservoirs to the mixing device 320. It should be noted that the locations of the reservoir for the rejuvenating agent such as a softener and the reservoir for the fresh asphalt as a modifying agent are not limited to the rearward portion of the blending device 310, but they may be disposed at any locations provided that the rejuvenating agent and/or the fresh asphalt can be added to the regenerated medium aggregates and the optionally added new materials before they are uniformly mixed by the mixing device 320. Therefore, in the case of the rejuvenating agent, the reservoir therefore may be located in the rear side of the grinders 220 of the miller vehicle 200 and/or in the vicinity of the mixing device 320 of the blender vehicle 300, whereby the rejuvenating agent can be added through a pipe extending from the reservoir to the asphalt mixture scarified by the grinders 220, and/or to the regenerated medium aggregates before the aggregates are uniformly mixed by the mixing device 320. Further, in the case of the fresh asphalt, the reservoir therefore may be located in the vicinity of the mixer 320 of the blender vehicle 300, whereby the fresh asphalt can be added through a pipe extending from the reservoir to the regenerated medium aggregates before the aggregates are uniformly mixed by the mixing device 320.

There are cases where, among the groups of regenerated aggregates classified in accordance with the particle size distributions, all or a part of the materials in one group or those in a plurality of groups may not be used depending upon the properties of the asphalt mixture in the existing pavement or the property requirements of the renewed asphalt mixture layer, or depending upon the need for the adjustment of the thickness of the renewed asphalt mixture layer. In such cases, the unused regenerated aggregates must be discharged out of the motor-driven vehicle system. It is preferable to provide a storing device and a transporting device in the motor-driven vehicle system to store the unused regenerated aggregates in the storing device, and discharge them out of the system by the transporting device.

(Mixer Vehicle)

FIG. 12 shows a mixer vehicle 400 in accordance with a preferred embodiment of the present invention. The mixer vehicle 400 is a vehicle for carrying out the first mixing process and the spreading and compacting process as shown in FIG. 7, and when required, for carrying out the processes for adding the rejuvenating agent and/or the fresh asphalt. The mixer vehicle 400 comprises a single mixing device 10 for uniformly mixing the regenerated fine aggregates and the regenerated coarse aggregates, as well as the optionally added new materials, the rejuvenating agent such as a softener and/or the fresh asphalt which may be added as a modifying agent, to provide a first regenerated asphalt mixture, a set of receiving/transporting/discharging devices 421, 422 and 423 located adjacent to the discharging outlet at the rear portion of the mixing device 320 of the blender vehicle 300, two sets of spreading/compacting device 430 and 440, for spreading and compacting the first regenerated asphalt mixture and the second regenerated asphalt mixture respectively, and a storing device 451 for the rejuvenating agent such as softener to be added to the regenerated fine aggregates and the regenerated coarse aggregates, and a storing device 452 for the fresh asphalt which is to be added as a modifying agent.

The regenerated fine and coarse aggregates possibly containing the optionally added new materials are thus discharged from the lower portion of the blending device 310 of the blender vehicle 300 to be spread on the road surface and then introduced, after being mixed when desired with the rejuvenating agent such as softener and the fresh asphalt serving as a modifying agent, into the mixing device 410 of the mixer vehicle 400 from the inlet opening 411 provided in the front portion of the mixing device 410. These materials are uniformly mixed in the mixing device 410 to provide the first regenerated asphalt mixture for use in the lower water impermeable layer of the regenerated asphalt mixture structure. According to the illustrated embodiment, the mixing device 410 for forming the first regenerated asphalt mixture is comprised of a pug mill mixer, it should however be noted that other type of devices may be used as well, provided that they are capable of uniformly mixing the regenerated fine and coarse aggregates as well as the new materials, the rejuvenating agent and/or the fresh asphalt if they are added. The first regenerated asphalt mixture prepared in the mixing device 410 is then discharged and spread on the road surface, in front of the foremost one 430 of two spreading/compacting devices 430 and 440 provided at a rearward portion with respect to the mixing device 410.

In order to introduce the second regenerated asphalt mixture prepared in the blender vehicle 300 into the mixer vehicle 400, the mixer vehicle 400 is provided with a carry-in device 421 located adjacent to the discharging outlet of the mixing device 320 of the blender vehicle 300. The second regenerated asphalt mixture introduced into the receiving device 421 at the front portion of the mixer vehicle 400 is then transported above the mixing device 410 of the mixer vehicle 400 to the discharging device 423 by means of a transporting device 422 to be discharged and spread on the road in front of the rearward one 440 of the aforementioned two spreading/compacting devices 430 and 440 provided rearwards of the mixing device 410. In the illustrated embodiment, the transporting device 422 is constituted by a belt conveyor, however, any other device such as a bar feeder, a slat conveyor or a screw conveyor may be used as well provided that it is capable of transporting the regenerated medium aggregates at a desired speed to the discharging device.

As in the case of the aforementioned regenerated medium aggregates for providing the second regenerated asphalt mixture, the regenerated fine aggregates and the regenerated coarse aggregates for forming the first regenerated asphalt mixture may be added with a rejuvenating agent such as softener and/or a fresh asphalt as modifying agent, based on the results of a preliminary property analysis of the materials. According to the present embodiment, the mixer vehicle 400 is provided in front of the mixing device 410 with a reservoir 451 for storing the rejuvenating agent and a reservoir 452 for storing the fresh asphalt. The rejuvenating agent and/or the fresh asphalt stored in the respective reservoirs 451 and 452 are introduced into the regenerated fine and coarse aggregates spread on the road, through respective pipes extending from the respective reservoirs. It should further be noted that the reservoir for the rejuvenating agent such as softener and the reservoir for the fresh asphalt serving as a modifying agent may not necessarily be located forwardly of the mixing device 410, but they may be located at any desired positions provided that the rejuvenating agent and/or the fresh asphalt as well as the new materials, if necessary, can be introduced into the regenerated fine and coarse aggregates before they are uniformly mixed together in the mixing device 410. It should therefore be understood that, in the case of a rejuvenating agent, the reservoir therefore may be located rear side of the grinder 222 in the miller vehicle 200, rear side of the blending device 310 of the blender vehicle 300, and/or, in the vicinity of the blending device 320 of the blender vehicle 300, whereby through a pipe extending from the reservoir, the rejuvenating agent can be introduced into the asphalt mixture scarified and loosened by the grinders 220, and/or into the regenerated fine and coarse aggregates which have been screened for classification and then metered by the blending device 310. Further, in the case of a fresh asphalt, the reservoir therefore may be located at a rear side portion of the blending device 310 of the blender vehicle 300, and/or in the vicinity of the mixing device 320 of the blender vehicle 300, whereby through a pipe extending from the reservoir, the fresh asphalt can be introduced into the regenerated fine and coarse aggregates which have been screened for classification and then metered by the blending device 310.

The first and second regenerated asphalt mixtures are both placed along a center line of a working width of the road, spread to a predetermined width, level, and compacted by means of the aforementioned two spreading/compacting devices 430 and 440 mounted on the rear side portion of the mixing device 410 of the mixer vehicle 400. Each of the two of spreading/compacting devices 430 and 440 includes a set of an auger 431 or 441 and a screed 432 or 442. The first regenerated asphalt mixture placed on the road surface is spread first to a predetermined width and leveled by the auger 431 of the forward one 430 of the aforementioned two spreading/compacting devices, and then compacted by the screed 432 located rearwardly of the auger 431 to form the first renewed asphalt mixture layer. The second regenerated asphalt mixture is distributed on the road surface after the first regenerated asphalt mixture has been spread and compacted by the foremost one 430 of the two spreading/compacting devices, then spread to a predetermined width and leveled by the auger 441 of the rearward one 430 of the two spreading/compacting devices, and thereafter compacted by the screed 442 located rearwards the auger 441 to provide a second renewed asphalt mixture layer. In the case where a two layer structure is not required in the renewed asphalt construction, use may be made only one of the two spreading/compacting devices 430 and 440.

In the present embodiment, two spreading/compacting device sets 430 and 440 are provided, and there are provided augers 431 and 441 for spreading and leveling operations, and screeds 432 or 442 for compacting operations. However, the number of spreading/compacting devices, and the number of spreading and leveling elements as well as the number of compacting elements constituting the spreading/compacting device may be changed in any way as long as such devices or elements can spread, level and compact the regenerated asphalt mixture placed over the road surface to a predetermined width.

The first and the second renewed asphalt mixture layers for providing a renewed asphalt structure are spread, leveled and compacted with the spreading/compacting devices 430 and 440 of the mixer vehicle 400. It should however be noted that the spreading/compacting devices 430 and 440 of mixer vehicle 400 only will not be sufficient to have the materials compacted to a satisfactory level so that the renewed structure may not be used as a renewed pavement. It is therefore preferable to conduct a finishing process, after the first and second renewed asphalt mixture layers are compacted respectively with the aforementioned two spreading/compacting device 430 and 440, by carrying out roll compacting operation simultaneously on the two layers, and for the purpose, the motor-driven vehicle system may be provided after the mixer vehicle with an additional compacting device. The additional compacting device may be the one which is currently used in a conventional method, and may include a road roller, a tire roller or a vibration roller.

What is claimed is:

1. A method for continuous on-site recycling of an asphalt mixture layer of a pavement with a motor-driven vehicle system moving along a road surface, the asphalt mixture layer comprising asphalt and individual particles of aggregates of different particle sizes, the asphalt serving as a binder for the individual particles of aggregates, wherein the method comprises the steps of:

a) applying heat to the asphalt mixture layer to soften the asphalt in the asphalt mixture layer;

b) scarifying and loosening the softened asphalt mixture layer to substantially retrieve therefrom the individual particles of aggregates of different particle sizes under a temperature which is sufficiently high to prevent re-aggregation of the loosened individual particles of aggregates through solidification of the softened asphalt;

c) screening the loosened individual particles of aggregates, under a temperature which is sufficiently high to prevent re-aggregation of the loosened individual particles of aggregates through solidification of the softened asphalt, to provide a plurality of groups of particles of aggregates separated from each other based on particle size;

d) selecting groups from among said plurality of groups, and blending the individual particles of aggregates from the selected groups in accordance with a specified mix ratio, under a temperature which is sufficiently high to prevent re-aggregation of the loosened individual particles of aggregates through solidification of the softened asphalt, to provide a regenerated asphalt mixture appropriate for use in pavement; and e) spreading and compacting the regenerated asphalt mixture over the road surface on which said steps a) and b) have been carried out to provide a renewed asphalt mixture layer on the road surface.

2. The method as defined in claim 1,wherein at least one of step b) and d) comprises a step of adding a rejuvenating agent.

3. The method as defined in claim 1,wherein said step d) comprises a step of storing one or more unused groups from among said plurality of groups of particles of aggregates of different particle sizes, and then discharging the one or more unused groups of particles out of the motor-driven vehicle system.

4. The method as defined in claim 1, wherein said step d) comprises a step of adding fresh asphalt mixture (new materials) to the blended and regenerated asphalt mixture.

5. The method as defined in claim 4,wherein said adding step comprises a step of adding a further fresh asphalt as modifying agent to the regenerated asphalt mixture to which the fresh asphalt mixture (new materials) has been added.

6. The method as defined in claim 1,wherein said step e) comprises a step of spreading and compacting the regenerated asphalt mixture to provide a two-layer construction having a base layer and a surface layer, wherein at least the base layer of the two-layer construction is a water impermeable, renewed asphalt mixture layer.

7. A method for continuous on-site recycling of an asphalt mixture layer of a pavement with a motor-driven vehicle system moving along a road surface, the asphalt mixture layer comprising asphalt and individual particles of aggregates of different particle sizes, the asphalt serving as a binder for the individual particles of aggregates, wherein the method comprises the steps of:

a) applying heat to the asphalt mixture layer to soften the asphalt in the asphalt mixture layer;

b) scarifying and loosening the softened asphalt mixture layer to substantially retrieve therefrom the individual particles of aggregates of different particle sizes under a temperature which is sufficiently high to prevent re-aggregation of the loosened individual particles of aggregates through solidification of the softened asphalt;

c) screening the loosened individual particles of aggregates, under a temperature which is sufficiently high to prevent re-aggregation of the loosened individual particles of aggregates through solidification of the softened asphalt, to provide a plurality of groups of particles of aggregates separated from each other based on particle size;

d) selecting groups from among said plurality of groups, and blending the individual particles of aggregates from the selected groups in accordance with a specified mix ratio, under a temperature which is sufficiently high to prevent re-aggregation of the loosened individual particles of aggregates through solidification of the softened asphalt, to provide a regenerated asphalt mixture appropriate for use in pavement;

e) mixing uniformly, under a temperature which is sufficiently high to prevent re-aggregation of the loosened individual particles of aggregates through solidification of the softened asphalt, the regenerated asphalt mixture;

f) wherein said step of mixing uniformly comprises the steps of:

(i) mixing uniformly a part of the blended and regenerated asphalt mixture to provide a first regenerated asphalt mixture for forming a renewed and dense graded, water impermeable asphalt mixture layer;

(ii) mixing uniformly all or a part of the remainder of the blended and regenerated asphalt mixture to provide a second regenerated asphalt mixture for forming a renewed and open graded, water permeable asphalt mixture layer;

g) spreading and compacting the first regenerated asphalt mixture over the road surface on which said steps a) and b) have been carried out to provide a renewed and dense graded, water impermeable asphalt mixture layer; and h) spreading and compacting the second regenerated asphalt mixture over the road surface on which said step g) has been carried out to provide a renewed and open graded, water permeable asphalt mixture layer on the renewed, water impermeable asphalt mixture layer.

8. The method as defined in claim 7, wherein at least one of steps b) and d) comprises a step of adding a rejuvenating agent.

9. The method as defined in claim 7, wherein said step c) comprises a step of screening the loosened individual particles of aggregates to provide two groups comprising fine aggregates and coarse aggregates, or three groups comprising fine aggregates, medium aggregates and coarse aggregates in accordance with particle sizes.

10. The method as defined in claim 7, wherein said step d) further includes a step of storing one or more unused groups from among said plurality of groups of particles of aggregates of different particle sizes, and then discharging said unused groups of particles out of the motor-driven vehicle system.

11. The method as defined in claim 7, wherein said step d) further includes a step of adding fresh asphalt mixture (new materials) to the regenerated asphalt mixture.

12. The method as defined in claim 11, wherein said step of adding further includes a step of adding fresh asphalt as modifying agent to the regenerated asphalt mixture to which the fresh asphalt mixture (new materials) has been added.

13. A motor-driven vehicle system including at least a pre-heater vehicle, a miller vehicle, a blender vehicle and a mixer vehicle for continuous on-site recycling of an asphalt mixture layer of a pavement with the motor-driven vehicle system moved along a road surface, said asphalt mixture layer including asphalt and individual particles of aggregates of different particle sizes, wherein the asphalt serves as a binder for the individual particles of aggregates, wherein:

a) said pre-heater vehicle having a device adapted to be disposed against the road surface for applying heat to the asphalt mixture layer to have the asphalt in the asphalt mixture layer softened;

b) said miller vehicle having a device for scarifying and loosening materials of thus softened asphalt mixture layer to substantially retrieve therefrom the individual particles of aggregates of different particle sizes under a temperature which is sufficiently high to prevent re-aggregation of the loosened individual particles through solidification of the asphalt;

c) said blender vehicle being provided with a device located at front thereof for scooping and transporting the scarified and loosened asphalt mixture, and a blending device located adjacent to said scooping and transporting device, said blending device including a screening device for screening the scooped and transported loosened individual particles to provide a plurality of groups of particles of aggregates separated from each other based on particle size, and a measuring device for metering a quantity of individual particles of aggregates in selected groups from among the plurality of groups, said blending device being configured for dispensing all or a part of the plurality of classified and metered groups of particles onto the road surface said blender vehicle being further provided with a device for maintaining the scarified and loosened asphalt mixture at a temperature which is sufficiently high to prevent re-aggregation of the loosened individual particles of the aggregates through solidification of the asphalt;

d) said mixer vehicle being provided with a mixing device including a pug mill adapted to be disposed against the road surface and having a front inlet and a rear outlet for receiving all or a part of the individual particles in the selected groups which have been dispensed onto the road surface and uniformly mixing the received materials and dispensing again, said mixer vehicle being further provided adjacent to said mixing device with a spreading/compacting device including one or more sets of auger and screed for spreading and compacting all or a part of the uniformly mixed and dispensed groups of materials to provide a renewed asphalt mixture layer, said mixer vehicle being further provided with a device for maintaining the scarified and loosened asphalt mixture at a temperature which is sufficiently high to prevent re-aggregation of the loosened particles of the aggregates through solidification of the asphalt.

14. The motor-driven vehicle system as defined in claim 13, wherein said pre-heater vehicle comprises one or more vehicles, each having at least a heating device adapted to be disposed against the asphalt mixture layer to be softened and apply heat thereto.

15. The motor-driven vehicle system as defined in claim 13, wherein said scarifying and loosening device of said miller vehicle includes one or more grinders.

16. The motor-driven vehicle system as defined in claim 13, said miller vehicle being further provided in front of said scarifying and loosening device with a heating device adapted to be disposed against the asphalt mixture layer to be softened for applying heat continuously thereto.

17. The motor-driven vehicle system as defined in claim 13, wherein a reservoir for a rejuvenating agent is provided rearwards of said scarifying and loosening device of the miller vehicle, and/or, rearwards of or in front of said mixing device of the mixer vehicle, said rejuvenating agent being added to the asphalt mixture which has been scarified and loosened by said scarifying and loosening device of the miller vehicle, and/or, to the asphalt mixture which has been classified and metered by said blending device of he blender vehicle.

18. The motor-driven vehicle system as defined in claim 13, said miller vehicle further including a receiving/transporting device comprising a receiving section including a hopper provided at a front portion and a transport section including a conveyor provided at an upper portion, said receiving/transporting device being adapted to receive a fresh asphalt mixture (new materials) supplied exteriorly of the motor-driven vehicle system under a temperature wherein re-aggregation of the loosened particulate materials can be prevented, and to transport the fresh asphalt mixture to the blender vehicle.

19. The motor-driven vehicle system as defined in claim 13, wherein said screening device in said blending device of said blender vehicle is configured for screening the divided individual particles of the aggregates of the asphalt mixture to provide at least two groups comprising fine aggregates and coarse aggregates, or three groups comprising fine aggregates, medium aggregates and coarse aggregates in accordance with particle sizes.

20. The motor-driven vehicle system as defined in claim 13, wherein said metering device in said blending device of said blender vehicle is configured for measuring each of groups classified into a plurality of groups of different particle size distributions in accordance with particle sizes.

21. The motor-driven vehicle system as defined claim 13, wherein said blender vehicle further includes a storing device for storing one or more unused groups of particles of different particle sizes in the plurality of groups, and for discharging them out of the motor-driven vehicle system.

22. The motor-driven vehicle system as defined in claim 18, wherein said blender vehicle includes a receiving/transporting/discharging device for receiving, transporting and discharging the fresh asphalt mixture (new materials) from the receiving/transporting device of the miller vehicle under a temperature wherein re-aggregation of the loosened particulate materials can be prevented, said receiving/transporting/discharging device having a discharging section including two discharge ports arranged one after the other, one of said discharge ports located in front of the other discharge port being adapted to add said fresh asphalt mixture (new materials) to all or a part of the materials in plurality of groups of different particle size distributions which has previously dispensed onto the road surface by the blender vehicle, said mixing device of the mixer vehicle being adapted to uniformly mix the materials added with the fresh asphalt mixture.

23. The motor-driven vehicle system as defined in claim 22, wherein said mixer vehicle is further provided in front of the mixing device of the vehicle with a storing device such as a tank for storing fresh asphalt to be used as modifying agent, whereby the fresh asphalt is added to all or a part of the materials in the plurality of groups which has been dispensed onto the road surface by said blending device of said blender vehicle, said mixing device being adapted to mix them uniformly.

24. The motor-driven vehicle system as defined in claim 22, wherein said blender vehicle is further provided, adjacent to said other discharge port located rearwards of said one discharge port of said receiving/transporting/discharging device of the vehicle, with a mixing device such as a pug mill having an inlet and an outlet device and, between said mixing device and said blending devices with a transporting device such as a conveyor for receiving a part of the classified and measured materials in the plurality of groups of different particle size distributions and for transporting the materials to said mixing device, whereby said part of the classified and measured materials in the plurality of groups of different particle size distributions is introduced into said mixing device from an opening thereof and the fresh asphalt mixture (new materials) is added thereto to be uniformly mixed in said mixing device.

25. The motor-driven vehicle system as defined in claim 24, wherein said blender vehicle further includes a storing device such as a tank for storing a supply of fresh asphalt as modifying agent in the vicinity of said mixing device of the vehicle, whereby the supply of fresh asphalt is added to a part of the plurality of groups which is being mixed in said mixing device.

26. The motor-driven vehicle system as defined in claim 24, wherein said mixing device of said blender vehicle is configured to add a supply of the fresh asphalt mixture (new materials) to a part of the plurality of groups of the classified and measured particles to uniformly mix them together to thereby provide a second regenerated asphalt mixture, said mixing device of the blender vehicle being further configured to add a supply of the fresh asphalt mixture (new materials) to all or a part of the remainder of the plurality of groups of the classified and measured particles to uniformly mix them together to provide a first regenerated asphalt mixture.

27. The motor-driven vehicle system as defined in claim 26, wherein said mixer vehicle is further provided adjacent to said mixing device with two sets including a first set and a second set of spreading/compacting devices such as two sets of augers and screeds, the first set of said spreading/compacting devices being configured for spreading and compacting said first regenerated asphalt mixture to form a first renewed asphalt mixture layer, the second set of said spreading/compacting devices being configured for spreading and compacting said second regenerated asphalt mixture to form a second renewed asphalt mixture layer over said first renewed asphalt mixture layer, to thereby provide a two-layered asphalt construction device.

28. The motor-driven vehicle system as defined in claim 27, wherein said first renewed asphalt mixture layer is at least a dense graded asphalt mixture layer which is water impermeable.

29. The motor-driven vehicle system as defined in claim 27, wherein said second renewed asphalt mixture layer is an open graded asphalt mixture layer which is water permeable.

30. The method as defined in claim 7, wherein said renewed asphalt mixture layer is one of a dense graded asphalt mixture which is water impermeable, an open graded asphalt mixture layer which is water permeable, and another asphalt mixture layer.

* * * * *